US007878254B2

(12) United States Patent
Abdollahi et al.

(10) Patent No.: US 7,878,254 B2
(45) Date of Patent: Feb. 1, 2011

(54) SYSTEMS, APPARATUS, AND METHODS FOR AUTONOMOUS TRIPPING OF WELL PIPES

(75) Inventors: Abdolreza Abdollahi, North Vancouver (CA); Carl A. Heinrich, Burnaby (CA)

(73) Assignees: Nabors Canada, Calgary, Alberta (CA); Canrig Drilling Technology International Ltd., Hamilton (BM)

( * ) Notice: Subject to any disclaimer, the term of this patent is extended or adjusted under 35 U.S.C. 154(b) by 0 days.

(21) Appl. No.: 12/334,173

(22) Filed: Dec. 12, 2008

(65) Prior Publication Data

US 2009/0159294 A1 Jun. 25, 2009

Related U.S. Application Data

(63) Continuation of application No. PCT/CA2007/001054, filed on Jun. 14, 2007.

(60) Provisional application No. 60/804,753, filed on Jun. 14, 2006.

(51) Int. Cl.
*E21B 19/00* (2006.01)

(52) U.S. Cl. ..... 166/379; 166/85.1; 166/77.52; 414/22.63; 414/22.65; 901/15

(58) Field of Classification Search ..... 166/379, 166/382, 85.1, 85.5, 77.52; 175/85; 414/22.63, 414/22.65; 901/31, 33, 36, 39, 15
See application file for complete search history.

(56) References Cited

U.S. PATENT DOCUMENTS 2,662,797 A 12/1953 Moon
3,552,506 A 1/1971 Mayer
3,664,439 A 5/1972 Council
4,042,123 A * 8/1977 Sheldon et al. ..... 414/22.71
4,077,525 A 3/1978 Callegari et al.
4,274,778 A * 6/1981 Putnam et al. ..... 414/22.71
4,345,864 A 8/1982 Smith, Jr. et al.
4,393,630 A 7/1983 Knox
4,453,595 A * 6/1984 Lagus et al. ..... 166/250.1

(Continued)

FOREIGN PATENT DOCUMENTS

CA 970358 7/1975

(Continued)

*Primary Examiner*—Kenneth Thompson
*Assistant Examiner*—Cathleen R Hutchins
(74) *Attorney, Agent, or Firm*—Haynes and Boone, LLP

(57) ABSTRACT

A robotic system coupled to a racking platform of an oil well service or drilling rig comprising a base coupled to the racking platform at a fixed location, a mast pivotally coupled to the base by a mast pivot joint allowing rotation of the mast about a mast axis, a mast actuator for controllably rotating the mast about the mast pivot joint, an arm coupled to the mast and moveable along a radial direction with respect to the mast axis, an arm actuator for controllably moving the arm along the radial direction, an end effector pivotally coupled to an end of the arm by an end effector pivot joint allowing rotation of the end effector about an end effector axis oriented generally parallel to the mast axis, and an end effector actuator for controllably rotating the end effector about the end effector pivot joint. The end effector comprises at least one grabbing member operable to selectively grab an elongated object under control of a grabbing member actuator.

21 Claims, 23 Drawing Sheets

U.S. PATENT DOCUMENTS

| | | | | |
|---|---|---|---|---|
| 4,531,875 | A | 7/1985 | Krueger | |
| 4,621,974 | A | 11/1986 | Krueger | |
| 4,696,207 | A | 9/1987 | Boyadjieff | |
| 4,709,766 | A | 12/1987 | Boyadjieff | |
| 4,725,179 | A | 2/1988 | Woolslayer et al. | |
| 4,862,973 | A | 9/1989 | Voigts et al. | |
| 5,107,940 | A | 4/1992 | Berry | |
| 6,821,071 | B2 | 11/2004 | Woolslayer et al. | |
| 6,860,337 | B1 | 3/2005 | Orr et al. | |
| 7,246,983 | B2 | 7/2007 | Zahn et al. | |
| 2006/0104747 | A1 * | 5/2006 | Zahn et al. | 414/22.63 |

FOREIGN PATENT DOCUMENTS

| | | |
|---|---|---|
| CA | 1077918 | 5/1980 |
| CA | 2488843 | 5/2006 |
| WO | WO 2006/073312 A3 | 7/2006 |

* cited by examiner

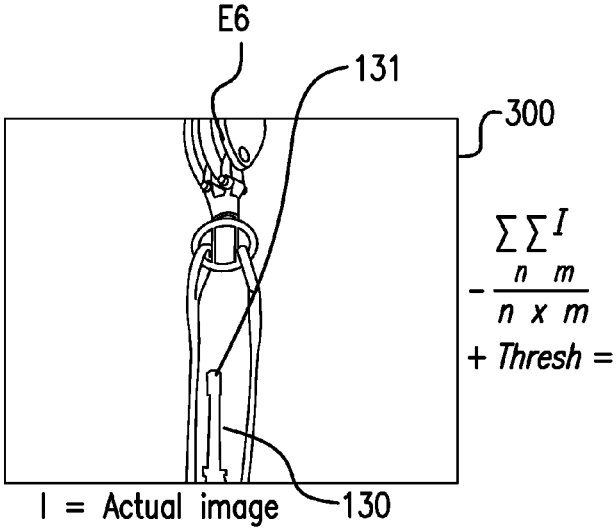
$$- \frac{\sum_n \sum_m I}{n \times m} + Thresh =$$
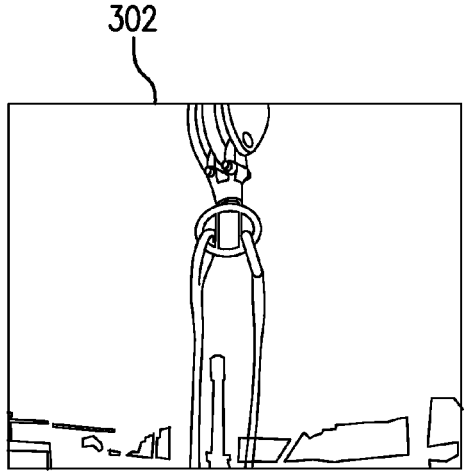
FIG.10A
FIG.10B
$\otimes G_\sigma(x,y) =$
$\sigma = 4$
$size = 10$
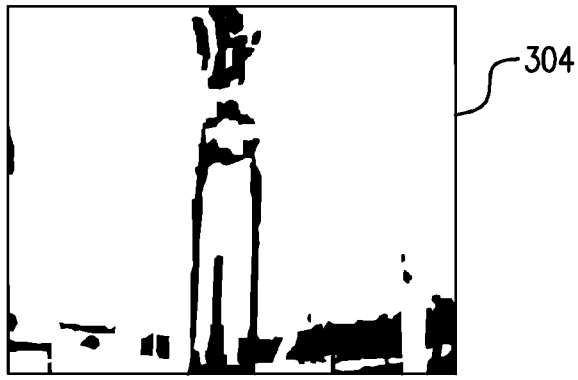
FIG.10C
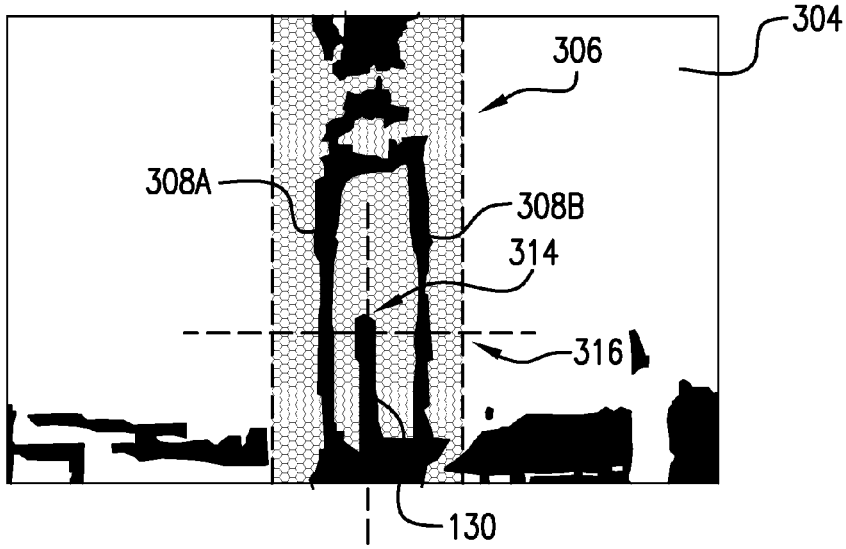
FIG.11A $$proj_{ver} = \sum_{y=1}^{m} I_{xy} \Big|_{x=1..n} \quad (4.1)$$

$$proj_{hor} = \sum_{x=1}^{n} I_{xy} \Big|_{y=1..m} \quad (4.2)$$

SYSTEMS, APPARATUS, AND METHODS FOR AUTONOMOUS TRIPPING OF WELL PIPES

REFERENCE TO RELATED APPLICATION

This is a continuation application of co-pending PCT/CA2007/001054, filed Jun. 14, 2007, which claims Paris Convention priority from U.S. Patent Application No. 60/804,753, filed on 14 Jun. 2006, the contents of each prior application being hereby incorporated herein in its entirety by express reference thereto.

TECHNICAL FIELD

This invention relates to manipulation of elongated objects, and certain embodiments relate to servicing oil wells. Particular embodiments of the invention provide systems and methods for autonomous tripping of oil well pipes.

BACKGROUND

One of the most hazardous tasks in industry is servicing oil wells to perform maintenance and/or repair operations on the oil wells. Oil well servicing involves removal of oil pipes from the ground (tripping out) and subsequent re-insertion of oil pipe into the ground (tripping in). Presently, oil well servicing requires significant human involvement and exposes workers to serious health and safety risks. Typical oil rig servicing systems require: a rig operator, who operates the elevator which lifts the pipe out of the ground and lowers the pipe into the ground; a ground operator, who handles the pipes that are being hoisted by the elevator and places the lower ends of the pipes into a drip tray; and a derrick man, who works on a raised platform (typically 20-55 feet above the ground) to manipulate the upper ends of the pipes into an upper racking board.

Oil well servicing involves a number of dangers, particularly for the derrick man on the raised platform. The raised platform on which the derrick man works is sometimes referred to colloquially as a "monkey board" because of its location well above the ground and the dangers posed to operators working thereon. Accidents during oil well servicing operations are costly to equipment and human lives and can damage the public image of the oil industry.

Protecting human lives in hazardous industrial applications has long been a foremost concern of industry. The inventors have determined that there exists a need to automate some of the tasks involved in oil well servicing and to provide systems for autonomously performing some of these tasks.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a robotic system coupled to a racking platform of an oil well service or drilling rig. The robotic system comprises a base coupled to the racking platform at a fixed location, a mast pivotally coupled to the base by a mast pivot joint allowing rotation of the mast about a mast axis, a mast actuator for controllably rotating the mast about the mast pivot joint, an arm coupled to the mast and moveable along a radial direction with respect to the mast axis, an arm actuator for controllably moving the arm along the radial direction, an end effector pivotally coupled to an end of the arm by an end effector pivot joint allowing rotation of the end effector about an end effector axis oriented generally parallel to the mast axis, and an end effector actuator for controllably rotating the end effector about the end effector pivot joint. The end effector comprises at least one grabbing member operable to selectively grab a elongated object under control of a grabbing member actuator.

Another aspect of the invention provides a mobile apparatus for oil well servicing. The apparatus comprises a mobile platform, a derrick pivotally coupled to the mobile platform and moveable between a deployed position and a storage position, a racking platform defining a plurality of elongated object receiving locations coupled to the derrick, an elevator supported from the derrick for raising and lowering elongated members along an elevator axis, and, a robotic system coupled to the racking platform at a fixed location, the robotic system comprising a mechanism having at least three degrees of freedom for manipulating an upper portion of an elongated member within a plane generally parallel to a plane of the racking platform.

Further aspects of the invention and features of specific embodiments of the invention are described below.

BRIEF DESCRIPTION OF DRAWINGS

In drawings which show non-limiting embodiments of the invention:

FIGS. 10A-10C depict image preprocessing steps according to a particular embodiment of the invention;

FIGS. 11A, 11B and 11C respectively depict image data, vertical projections of the image data and horizontal projections of the image data according to a particular embodiment of the invention;

DESCRIPTION

Figure 1:
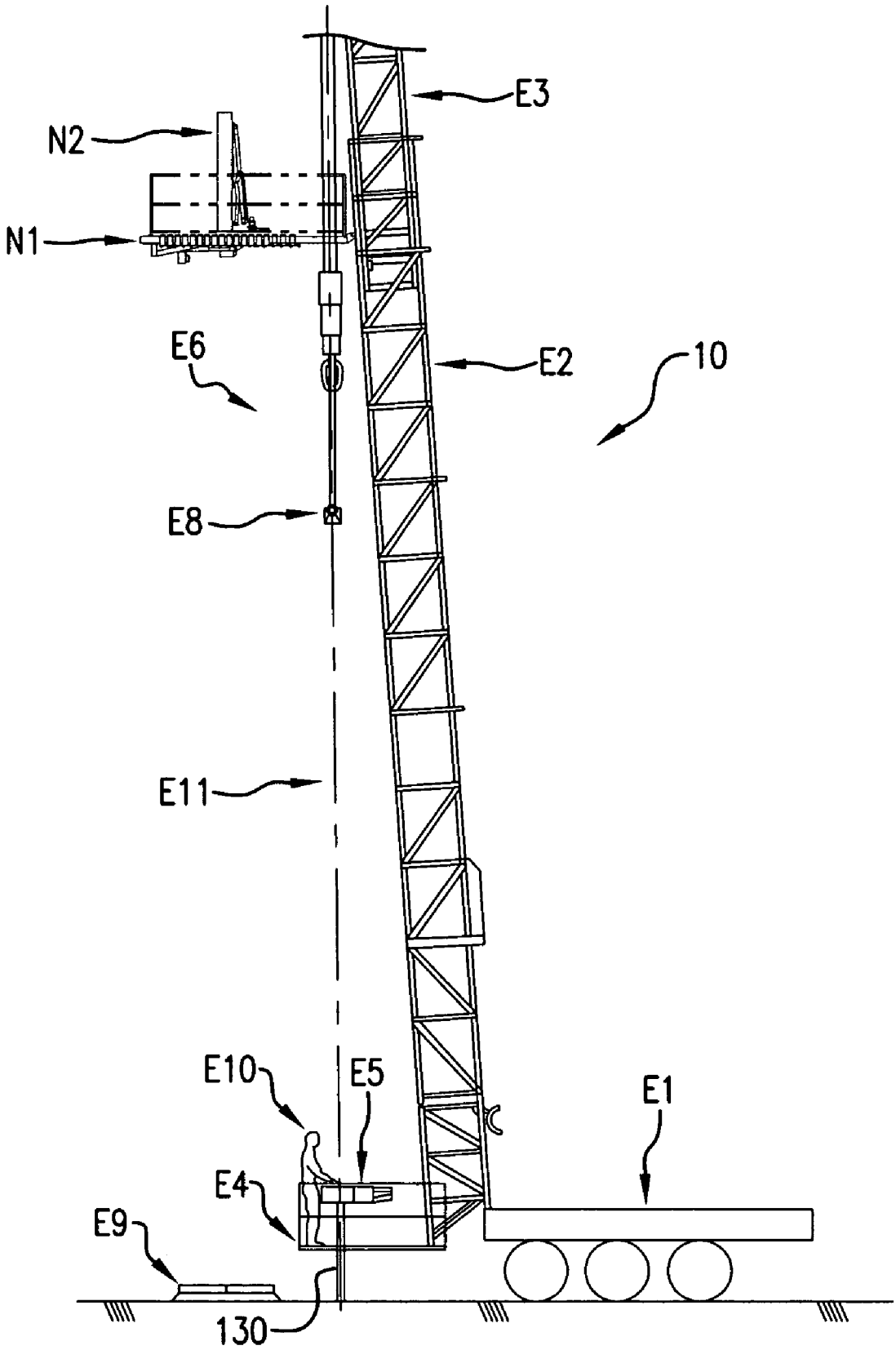
FIG. 1 is a schematic side plan view of an automated oil well tripping system according to a particular embodiment of the invention.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIGS. 1-5C schematically depict a system 10 for autonomously performing portions of the tripping (in and out) operations involved in oil well servicing in accordance with a particular embodiment of the invention. In the illustrated embodiment, system 10 is a mobile system which is capable of servicing different oil wells. To achieve this mobility, system 10 has a relatively lightweight construction in comparison to existing oil well servicing systems, and is supported by a mobile platform E1. Mobile platform E1 may be towed by a truck, tractor or other suitable vehicle. It is not generally necessary that system 10 is mobile. System 10 may be associated with and used to service a particular oil well.

Mobile platform E1 supports a derrick E2. Preferably, derrick E2 is pivotally coupled to platform E1, such that derrick E2 may be pivoted between a generally vertical orientation (shown in FIG. 1) and a generally horizontal orientation (not shown) atop mobile platform E1. Derrick E2 supports an operating platform E4 and a racking platform N1. Derrick E2 may comprise a derrick extension E3 to which racking platform N1 is coupled. In some embodiments, racking platform N1 may be pivotally coupled to derrick E2 such that racking platform N1 may be pivoted to be generally parallel to derrick E2 when derrick E2 is in the generally horizontal orientation to facilitate transportation of system 10.

In typical embodiments, when derrick E2 is in its generally vertical orientation, operating platform E4 is located less than 10 feet above the ground (or above the top of an oil well) and racking platform N1 may be located between 20 and 80 feet above operating platform E4. In some embodiments, the position of derrick extension E3 is adjustable along the length of derrick E2, such that the location of racking platform N1 is adjustable. The location of operating platform E4 may also be adjustable.

Derrick E2 also supports a crane system E6, which may be referred to as an "elevator". Elevator E6 comprises a pipe coupler E8 for coupling to oil well pipes 30. Elevator E6 also comprises a suitable actuator (not shown) for moving pipe coupler E8 (and any pipe 130 to which it is coupled) upwardly and downwardly along the general direction of elevator axis E11. Elevators are well known in the field of oil well servicing and are not explained further herein.

System 10 comprises a robotic system N2 which is mounted to racking platform N1. Robotic system N2 may be mounted at a fixed location on racking platform N1. As discussed in more detail below, robotic system N2 is configured to interact with an upper portion of an elongated object such as, for example, an oil well pipe 130, such that a human being is not required on racking platform N1 to perform tripping operations. In some embodiments, robotic system N2 comprises a mechanism having at least three degrees of freedom for manipulating an end of an elongated object within a plane generally parallel to a plane of racking platform N1. System 10 also comprises one or more suitably programmed system controllers (not shown in FIGS. 1-5C) for controlling the operation of robotic system N2.

Figure 2A:
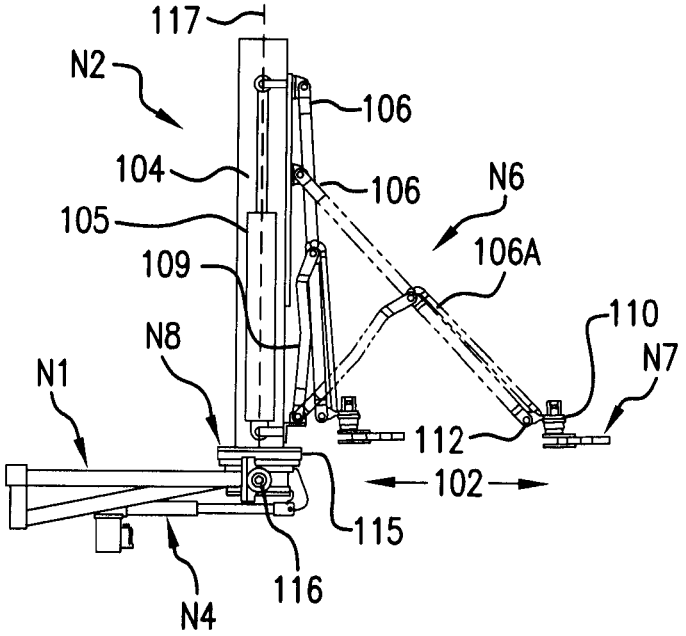
FIGS. 2A, 2B and 2C respectively represent side, top and side views of the robotic system of the FIG. 1 tripping system in various configurations.
Figure 2B:
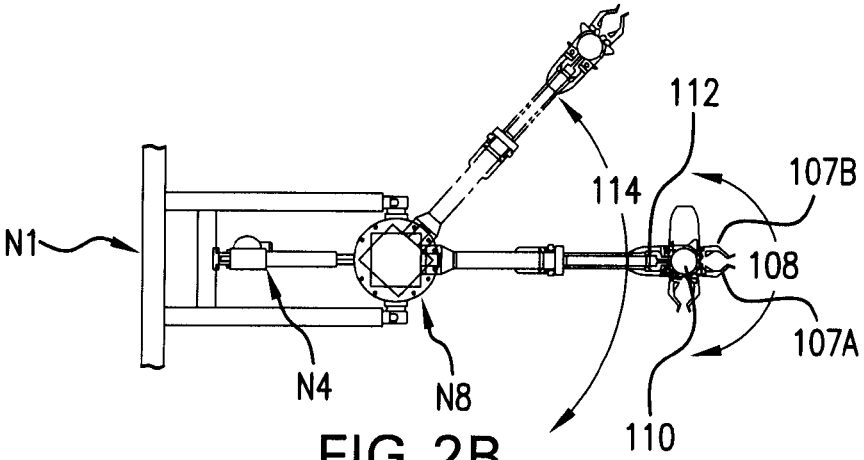
Figure 2C:
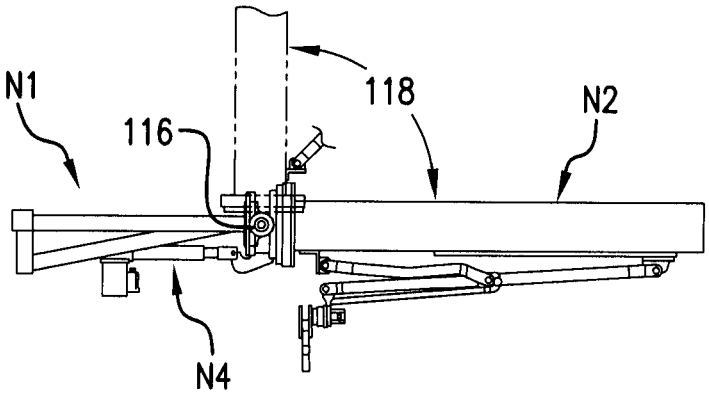

FIGS. 2A-2C schematically depict more detail of a robotic system N2 according to a particular embodiment of the invention. In general, robotic system N2 comprises a mechanism for controllably moving an end effector N7 capable of engaging or otherwise interacting with pipe 130. In some embodiments, robotic system N2 makes use of one or more sensors to determine one or more positional characteristics of pipe 130. Such sensors may comprise, for example, laser sensors, ultrasonic sensors or magnetic sensors. In some embodiments, robotic system N2 may be preprogrammed with known positional characteristics of pipe 130.

Robotic system N2 also makes use of one or more sensors to determine one or more positional characteristics of end effector N7. Based on the positional characteristics of pipe 130 and end effector N7, robotic system N2 may cause end effector N7 to autonomously engage and disengage pipe 130 to perform tripping operations. When pipe 130 is engaged by end effector N7, robotic system N2 may controllably manipulate the position of end effector N7 and thereby controllably manipulate the position of pipe 130.

In the illustrated embodiment, robotic system N2 comprises a manipulable robot arm N6 coupled to an elongated mast 104. End effector N7 is coupled to an end of arm N6 opposite mast 104. As shown in FIGS. 2A-2C, arm N6 may comprise a mechanical assembly having a plurality of segments moveably coupled to one another to facilitate movement of end effector N7 in along a radial direction shown by double-headed arrow 102. This radial movement of arm N6 provides robotic system N2 with a first degree of freedom.

In the illustrated embodiment, arm N6 comprises segments 106, 106A and 109. Segments 106 and 109 are each pivotally coupled to mast 104 at inner (i.e., closer to mast 104) ends thereof. Segment 109 is pivotally coupled to a middle portion of segment 106, and segment 106A is pivotally coupled to the outer (i.e., farther from mast 104) end of segment 109. Segments 106 and 106A are coupled to a pivot joint 112 at the end of arm N6 to which end effector N7 is coupled, such that the relative orientation between mast 104 and end effector N7 is maintained as arm N6 moves along the radial direction. FIG. 2A shows how the relative orientation between mast 104 and end effector N7 is maintained when arm N6 is retracted toward mast 104 and extended away from mast 104. As shown in FIG. 2A, when mast 104 is generally vertically oriented, end effector N7 is generally horizontally oriented.

In the illustrated embodiment, mast 104 houses a suitable arm actuator 105. In some embodiments, the arm actuator 105 may comprise, for example, a servo motor, another type of motorized actuator, or a hydraulic actuator. The arm actuator 105 is capable of moving arm segment 106 of arm N6 along the elongated dimension of mast 104. When the arm actuator 105 moves arm segment 106 toward arm segment 109 (e.g. downwardly in FIG. 2A), arm N6 causes end effector N7 to extend away from mast 104. Conversely, when the actuator 105 moves arm segment 106 away from arm segment 109 (e.g. upwardly in FIG. 2A), arm N6 causes end effector N7 to be withdrawn toward mast 104. Other mechanisms and actuators could be used to implement arm N6 and to provide the functionality described herein.

Robotic system N2 also comprises one or more sensors (not specifically enumerated) capable of detecting information which enables the system controller to determine the current configuration/position of arm N6 (and/or the position of end effector N7) relative to mast 104. Such sensors may comprise one or more encoders coupled to one or more of the joints of arm N6, one or more sensors coupled to the arm actuator which causes arm N6 to move and/or one or more other suitably configured sensors. Those skilled in the art will appreciate that the system controller may be programmed with a model of arm N6, such that the information provided by such sensors may be used to determine the current configuration/position of arm N6 (and/or end effector N7).

End effector N7 is pivotally coupled to the end of arm N6 by an end effector pivot joint 110 to allow pivotal movement of end effector N7 in the directions shown by double-headed arrow 108 (FIG. 2B). This pivotal coupling of end effector N7 to arm N6 provides robotic system N2 with a second degree of freedom. Robotic system N2 comprises an end effector actuator (see FIG. 2D) for manipulating end effector N7 about pivot joint 110. The end effector actuator may comprise, for example, a servo motor or some other type of actuator.

End effector N7 comprises at least one grabbing member operable to selectively grip an elongated object such as, for example, pipe 130. In the illustrated embodiment, end effector N7 comprises a pair of opposable grabbing members 107A, 107B which are shaped for grasping an oil well pipe 130 around a portion of its circumferential surface. Grabbing members 107A and 107B may be selectively opened and closed by a grabbing member actuator located within end effector, under control of the system controller. The inner surfaces of grabbing members 107A and 107B may be curved and/or angled to fit around the circumferential surface of oil well pipe 130. In other embodiments, end effector N7 may take other forms that provide the functionality described herein.

Figure 2D:
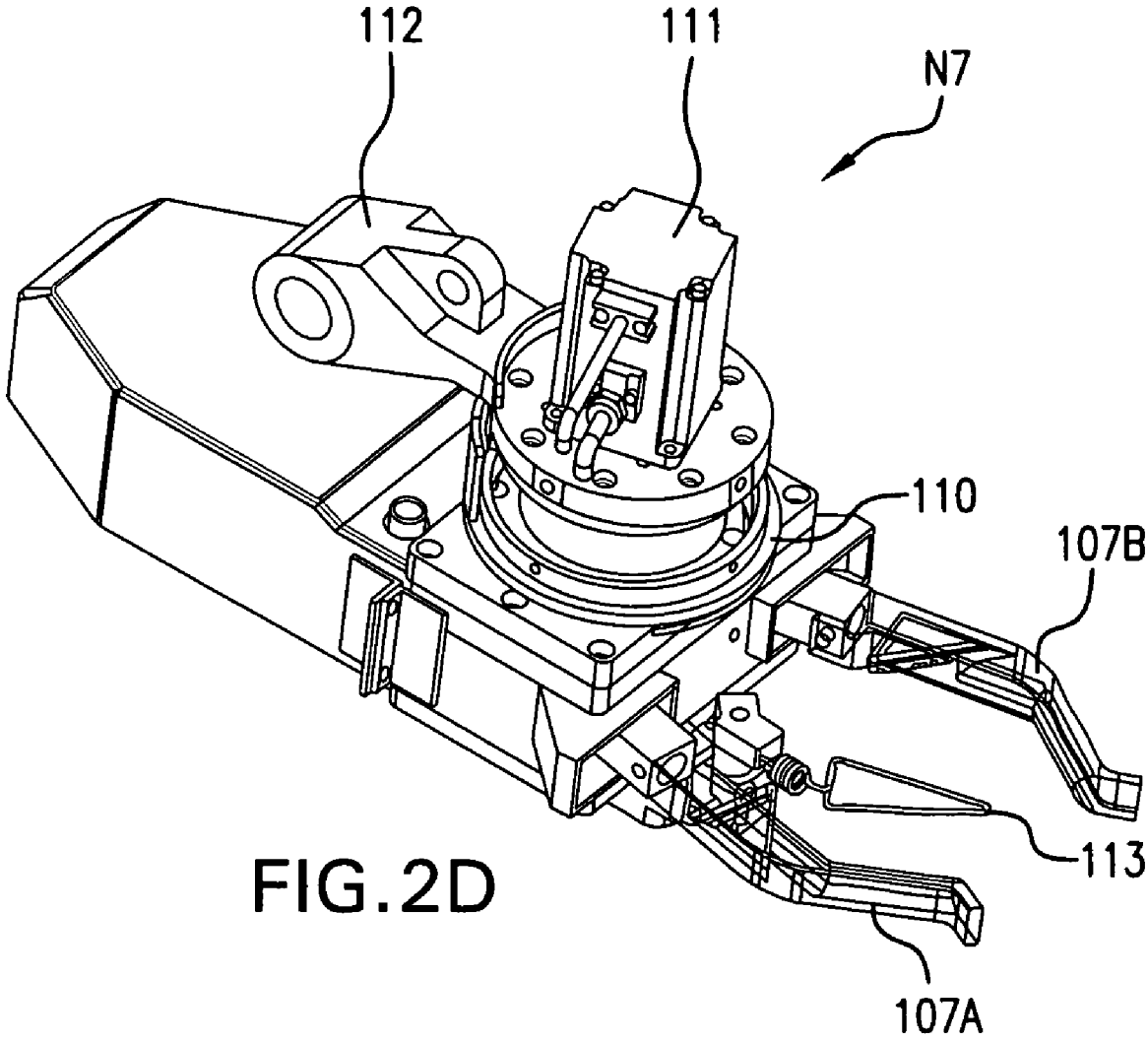
FIG. 2D is an isometric view of an end effector according to a particular embodiment of the invention.

FIGS. 2D-G show more details of end effector N7 according to a particular embodiment. Various components of end effector N7 are omitted or depicted transparently in FIGS. 2D-G so that internal components thereof may be shown. As shown in FIG. 2D, an end effector actuator 111 is coupled between pivot joint 112 and pivot joint 110 for manipulating end effector N7 about pivot joint 110. End effector actuator 111 may comprise, for example, a harmonic drive coupled to a reducing gearbox. End effector actuator 111 is typically covered by a cylindrical cover (not shown in FIG. 2D). A mechanical switch 113 may be positioned between grabbing members 107A and 107B, which is activated when an elongated object is received between grabbing members 107A and 107B to provide the system controller with an indication that the elongated object is in position for grabbing. Instead of or in addition to mechanical switch 113, ultrasonic, infrared, magnetic or other sensors may be provided for detecting the presence of a pipe 130 between grabbing members 107A and 107B.

Figure 2E:
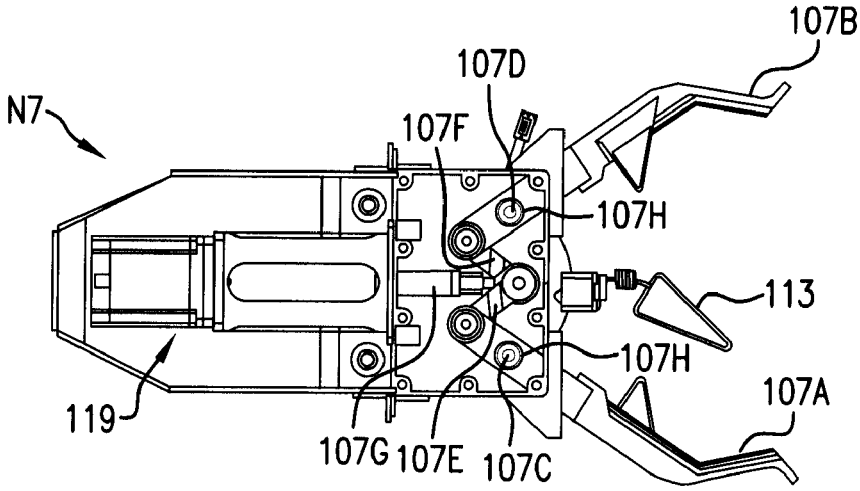
FIGS. 2E-G show internal links of the end effector of FIG. 2D in various positions.
Figure 2F:
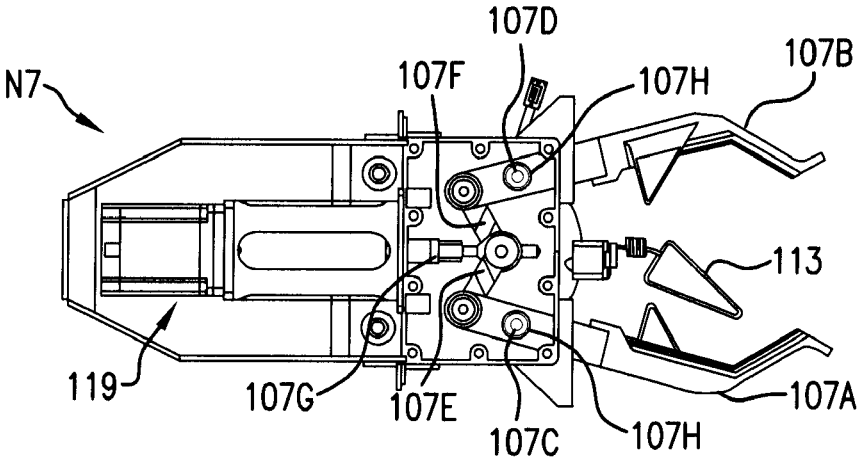
Figure 2G:
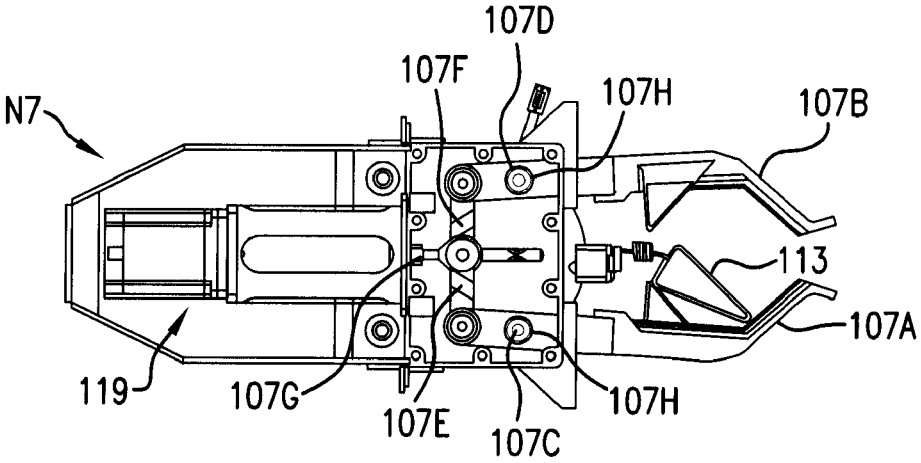
Figure 3A:
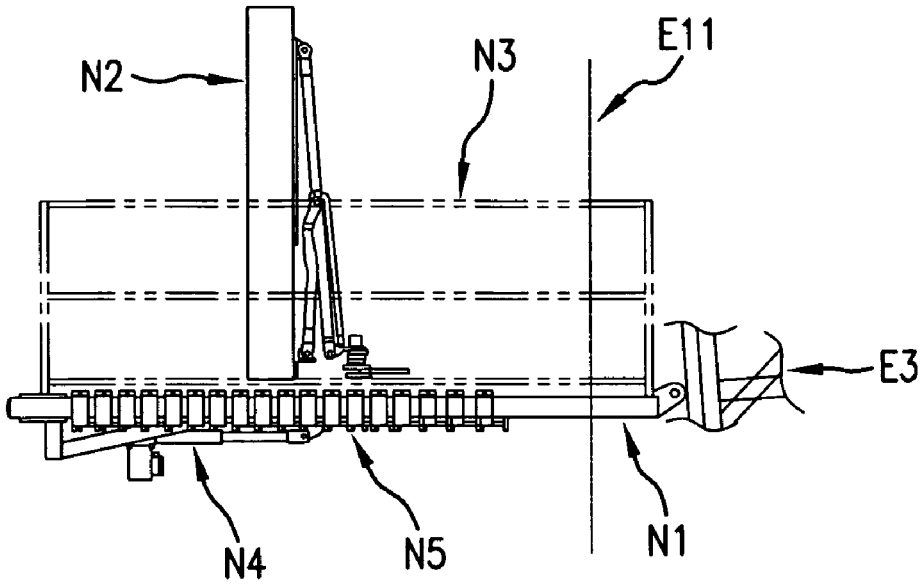
FIGS. 3A and 3B respectively represent side and top plan views of the rack and the robotic system of the FIG. 1 tripping system.
Figure 3B:
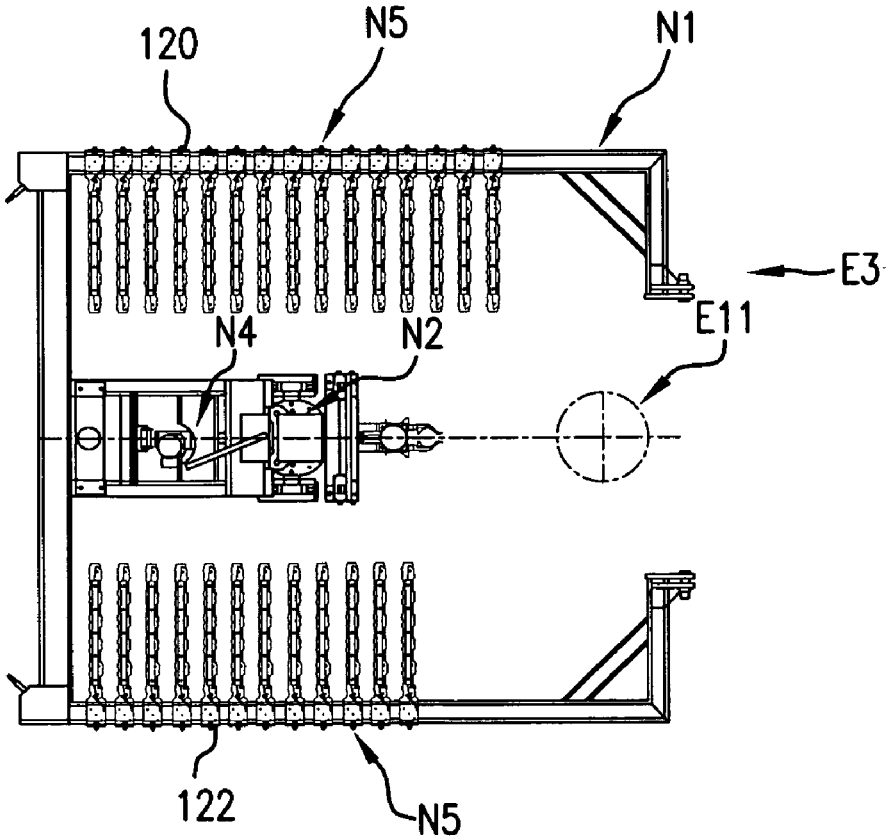

As shown in FIGS. 2E-G, grabbing members 107A and 107B are pivotally coupled to a housing of end effector N7 by fixed pivot joints 107C and 107D. Fixed pivot joints 107C and 107D may comprise rubber bushings 107H or the like to absorb shocks generated from a pipe contacting grabbing members 107A and 107B. Grabbing members 107A and 107B are coupled to a grabbing member actuator 119 by means of pivoting links 107E and 107F and an extendable member 107G. Grabbing member actuator 119 may comprise, for example, a stepper motor, another type of motorized actuator, or a hydraulic actuator.

In the illustrated embodiment, grabbing member actuator 119 may extend extendable member 107G to move grabbing members 107A and 107B into an open position, as shown in FIG. 2E, and may retract extendable member 107G to move grabbing members 107A and 107B into a closed position, as shown in FIG. 2G. When in the closed position, pivoting links 107E and 107F are positioned to oppose any opening of grabbing members 107A and 107B, such that end effector N7 is self-locking.

Grabbing members 107A and 107B may be detachable in some embodiments, so that different fingers may be provided to allow end effector N7 to grip pipes having different diameters. This permits grabbing member actuator 119 to move through the same range of motion to move grabbing members 107A and 107B between the closed and open positions for different pipes. In some embodiments, grabbing members 107A and 107B may be selected such that there is approximately ⅛th of an inch clearance between the inner surfaces of grabbing members 107A and 107B and a pipe when grabbing members 107A and 107B are in the closed position shown in FIG. 2G.

Robotic system N2 also comprises one or more sensors (not specifically enumerated) capable of detecting information which enables the system controller to determine the current configuration/position of end effector N7 relative to arm N6 and/or mast 104 and the current position of grabbing members 107A and 107B relative to end effector N7 and/or to one another. Such sensors may comprise encoders coupled to one or more of pivot joints 110, 112 and/or the pivot joints within end effector N7, sensors coupled to end effector actuator 111 and/or grabbing member actuator 119, or other suitably configured sensors. In some embodiments, sensors may also be provided for detecting torque on end effector N7 and/or grabbing members 107A and 107B. Those skilled in the art will appreciate that the system controller may be programmed with a model of end effector N7, such that the information provided by such sensors may be used to determine the current configuration/position of end effector N7 and grabbing members 107A and 107B.

Returning to FIGS. 2A-C, robotic system N2 comprises a base 115 coupled to a fixed location on racking platform N1. Mast 104 is pivotally coupled to base 115 by a pivot joint N8 to allow pivotal movement of mast 104 (and arm N6) about a mast axis 117 in the directions shown by double-headed arrow 114 (FIG. 2B). This pivotal coupling provides robotic system N2 with a third degree of freedom. Robotic system N2 comprises a mast actuator (not specifically enumerated) for manipulating mast 104 about pivot joint N8. The mast actuator may comprise, for example, a servo motor, a harmonic drive and a reducing gearbox, another type of motorized actuator, or a hydraulic actuator. Robotic system N2 also comprises one or more sensors for detecting the position of mast 104 about pivot joint N8. These sensors may comprise one or more encoders coupled to pivot joint N8, one or more sensors coupled to the mast actuator or one or more other suitably configured sensors.

Base 115 of robotic system N2 may be pivotally coupled to racking platform N1 by a pivot joint 116 for pivotal movement of robotic system N2 in the directions shown by double-headed arrow 118 (FIG. 2C). In the illustrated embodiment, a hydraulic actuator N4 is provided for manipulating robotic system N2 about pivot joint 116 between an operating position (FIG. 2A), wherein mast 104 extends generally perpendicularly to the plane of racking platform N1 and a storage position (FIG. 2C), wherein mast 104 lies generally within the plane of racking platform N1. In other embodiments, actuator N4 may comprise a different type of actuator (e.g. a motorized actuator). Robotic system N2 may also comprise one or more sensors for detecting the position of robotic system N2 about pivot joint 116. These sensors may comprise one or more encoders coupled to pivot joint 116, one or more sensors coupled to actuator N4 or one or more other suitably configured sensors.

Figure 4A:
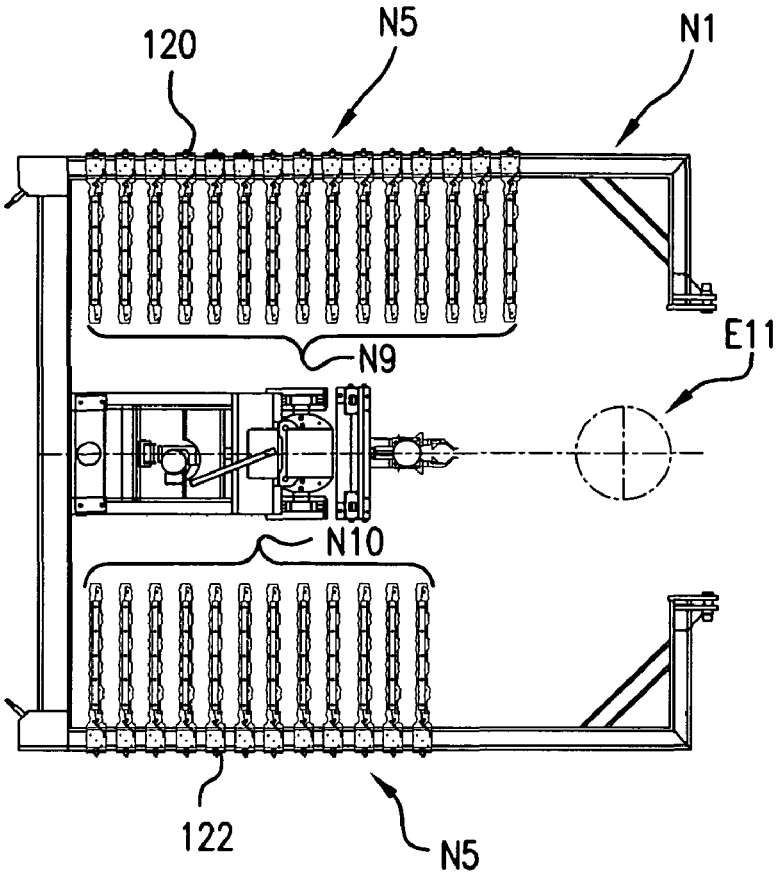
FIGS. 4A and 4B respectively represent top and side views of the rack of the FIG. 1 tripping system.
Figure 4B:
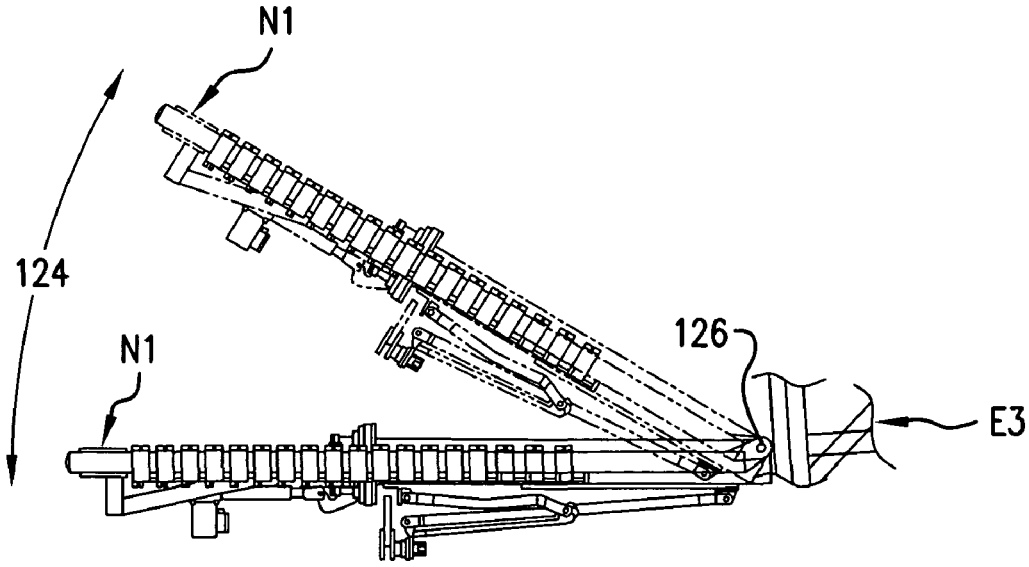

FIGS. 3A, 3B, 4A and 4B schematically depict racking platform N1 in more detail. Racking platform N1 comprises an adjustable pipe rack N5. Rack N5 securely stores oil well pipes 130 after they are removed from an oil well or before they are inserted into an oil well. In the illustrated embodiment, rack N5 comprises a number of slidably adjustable pipe rack fingers N9, N10 mounted on a frame of racking platform N1. On one side 120 of racking platform N1, pipe rack fingers N9 are slidably adjusted such that their spacing (relative to one another) will accommodate pipes having a first diameter. On the opposing side 122 of racking platform N1, pipe rack fingers N10 are slidably adjusted such that their spacing (relative to one another) will accommodate pipes having a second diameter. As shown in FIG. 4B, racking platform N1 may travel through an arc (shown by double-headed arrow 124) about a pivotal coupling 126 to derrick extension E3. A suitable actuator (not specifically enumerated) may be provided to effect this movement of racking platform N1 about pivotal coupling 126.

FIGS. 5A-D schematically depict adjustable pipe rack fingers N10 in detail. It should be understood that pipe rack fingers N9 are substantially similar to pipe rack fingers N10. Pipe rack fingers N10 comprise a plurality of finger members N13. In the illustrated embodiment, finger members N13 are slidably mounted to racking platform N1 by adjustable coupling mechanism N11 and suitable fasteners N12. Finger members N13 may generally be coupled to racking platform N1 using any suitable mechanism. Preferably, this coupling mechanism may comprise actuators N17A to provide adjustable spacing N17 between finger members N13. In the illustrated embodiment, each finger member N13 comprises a plurality of concave pipe-receiving portions 132 for receiving a portion of the circumferential surface of a pipe 130. Concave pipe-receiving portions 132 may be arcuate.

A plurality of toggle locks N14 and N16 may be pivotally coupled (at pivot joints 134) to each finger member N13. Toggle locks N14 and N16 may be held in place by retaining bars N18. Each toggle lock N14 may be arranged in a complementary pair with a corresponding one of toggle locks N16. In the illustrated embodiment, toggle locks N14 extend from their respective pivot joints 134 toward an open end 133 of pipe rack fingers N10 (i.e. in the direction of arrow 142). In the illustrated embodiment, each toggle lock N14 comprises a concave pipe-receiving portion 136 shaped to receive a portion of the circumferential surface of a pipe 130. Concave portions 136 may be arcuate.

Figures 5A, 5B, 5C:
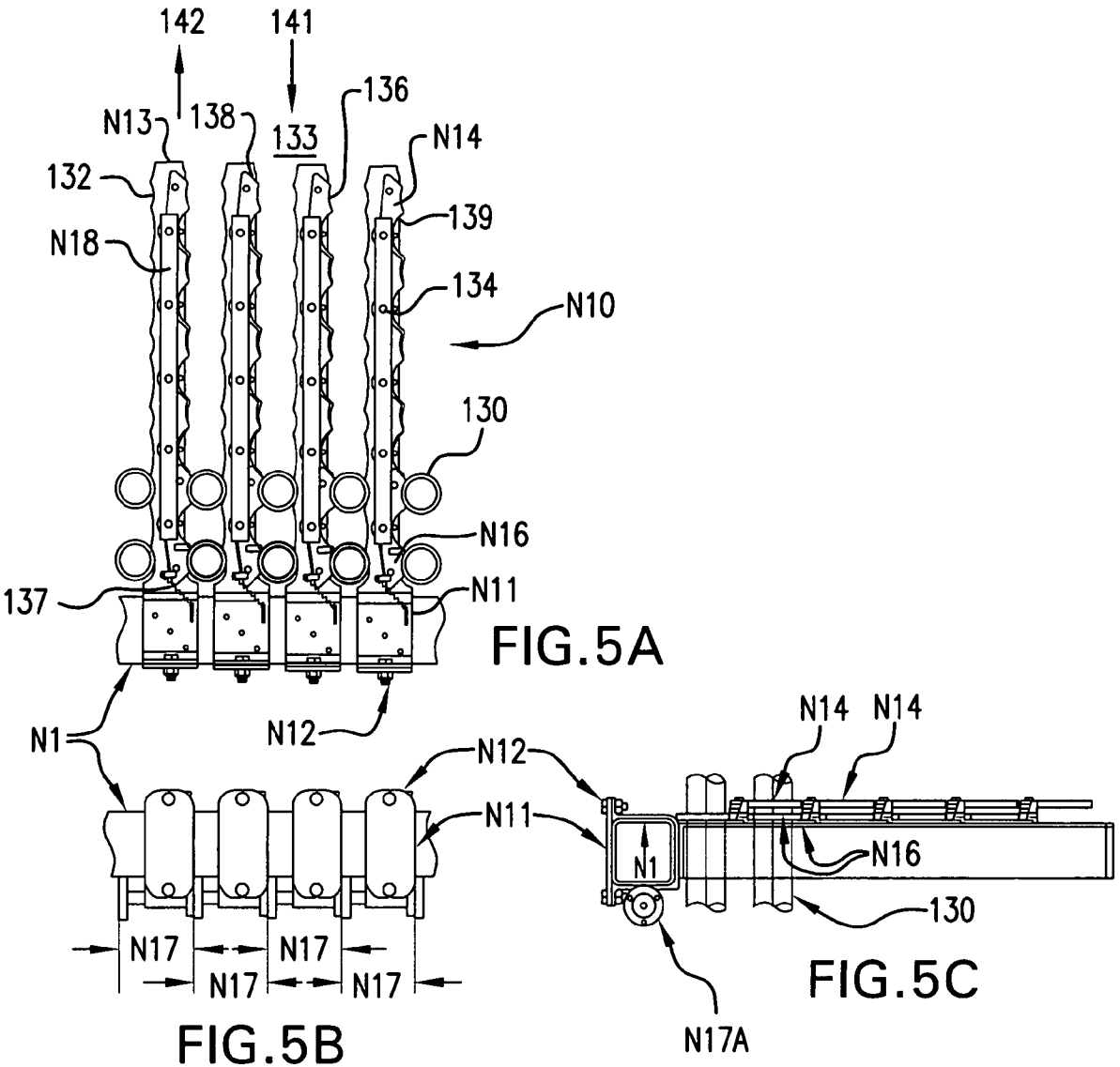
FIGS. 5A, 5B and 5C respectively represent partial top, side and cross-sectional views of the rack of the FIG. 1 tripping system.

In the illustrated embodiment, each toggle lock N14 also comprises first and second beveled portions 138, 139. First beveled portion 138 is shaped such that force applied against first beveled portion 138 in the direction of arrow 141 will cause the corresponding toggle lock N14 to pivot about its pivot joint 134 out of the path between finger members N13 (i.e. in a counterclockwise direction in the FIG. 5A illustration). Second beveled portion 139 is shaped such that force applied against the second beveled portion 139 in the direction of arrow 142 will also cause the corresponding toggle lock N14 to pivot about its pivot joint 134 out of the path between finger members N13 (i.e. in a counterclockwise direction in the FIG. 5A illustration). Toggle locks N16 are substantially similar to toggle locks N14, except that toggle locks N16 are oriented in the opposite direction (i.e. they extend away from pivot joints 134 in the direction of arrow 141) and toggle locks N16 are spaced apart from toggle locks N14 in the axial direction of pipes 130 (see FIGS. 5C and 5D).

Figure 5D:
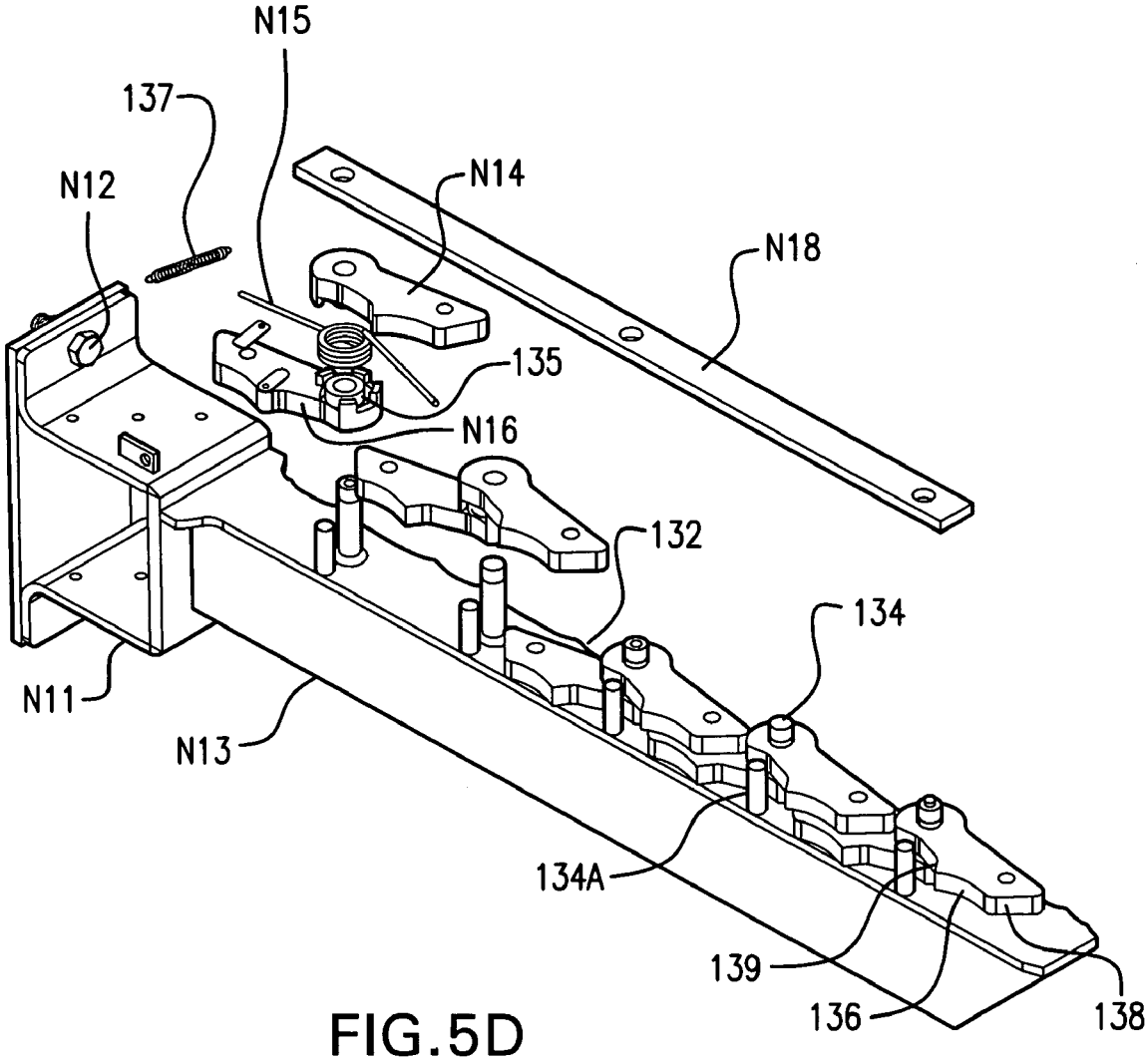
FIG. 5D is an exploded view of a finger member of the rack of the FIG. 1 tripping system.

As best seen in FIG. 5D, a spring N15 may be coupled between corresponding pairs of toggle locks N14 and N16 to bias each pair of toggle locks N14 and N16 into a predetermined angular relationship with one another. Each pair of toggle locks N14 and N16 may comprise interlocking features 135 which limit the range of angular movement therebetween. Each pair of toggle locks N14 and N16 except the "last" pair closest to coupling mechanism N11 (i.e., the pair farthest from open end 133) may be free to rotate about the corresponding pivot joint 134. The last pair of toggle locks N14 and N16 may be provided with a biasing mechanism 137 (which may comprise, for example, a tension coil spring) for biasing the last toggle lock N16 into a pipe retaining position wherein toggle lock N16 extends into the path between finger members N13 (i.e., in a counterclockwise direction in the FIG. 5D illustration). Posts 134A may be provided on finger member N13 to limit the range of motion of each pair of toggle locks N14 and N16 about pivot joints 134. The concave pipe-receiving portions 136 of adjacent toggle locks N14, N16 from different pairs (other than the first toggle lock N14 and the last toggle lock N16) may overlap one another, such that toggle locks N14, N16 operate in tandem to retain pipes 130 (except at the ends of finger members N13), as described below with reference to FIGS. 5E-J.

Figure 5E:
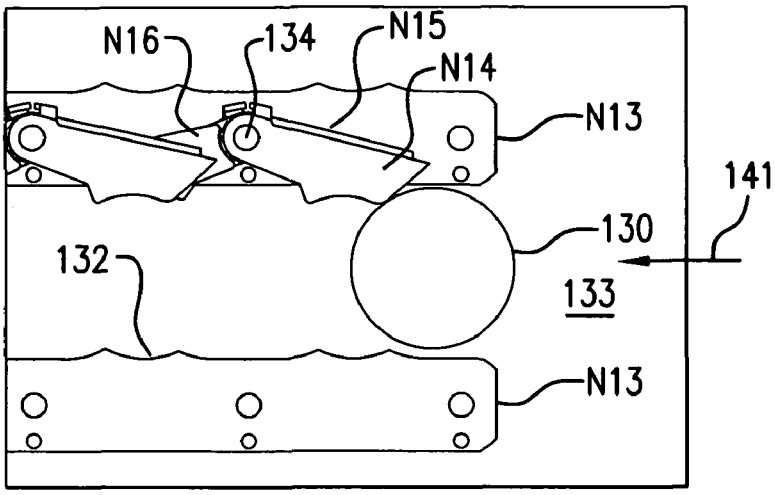
FIGS. 5E-5I represent top plan views of a pipe being inserted into the rack of the FIG. 1 tripping system.
Figure 5F:
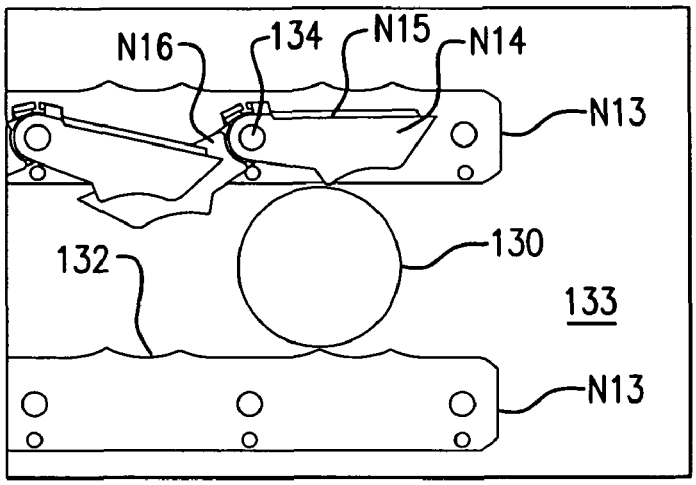
Figure 5G:
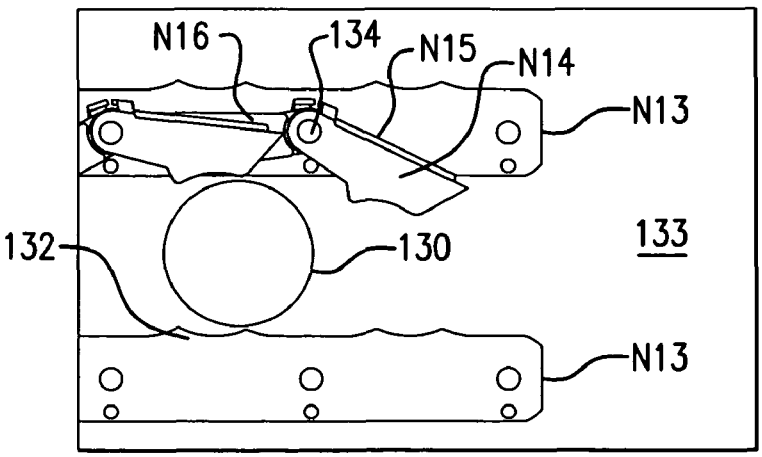

FIGS. 5E-5J illustrate how pipes 130 may be inserted into pipe rack fingers N10 according to a particular embodiment. As shown in FIG. 5E, a pipe 130 is inserted into pipe rack fingers N10 between finger members N13 from open end 133 (e.g. in the direction of arrow 141). As pipe 130 is inserted it encounters the first beveled end 138 of a first toggle lock N14. The pipe 130 being inserted causes the first pair of toggle locks N14 and N16 to pivot about pivot joint 134 to move toggle lock N14 out of the path between finger members N13, as shown in FIG. 5F. Next, as shown in FIG. 5G, pipe 130 encounters second beveled end 139 of toggle lock N16, which causes the first pair of toggle locks N14 and N16 to pivot about pivot joint 134 to move toggle lock N16 out of the path between finger members N13. This process continues until pipe 130 reaches its racking location defined by one of the pipe receiving portions 132 on opposing finger member N13. If pipe 130 is the first pipe being inserted between two adjacent finger members N13, pipe 130 must be pushed with enough force to overcome biasing mechanism 137 to be moved into its racking location, and the last toggle lock N16 retains the pipe in its racking location through the action of biasing mechanism 137.

Figure 5H:
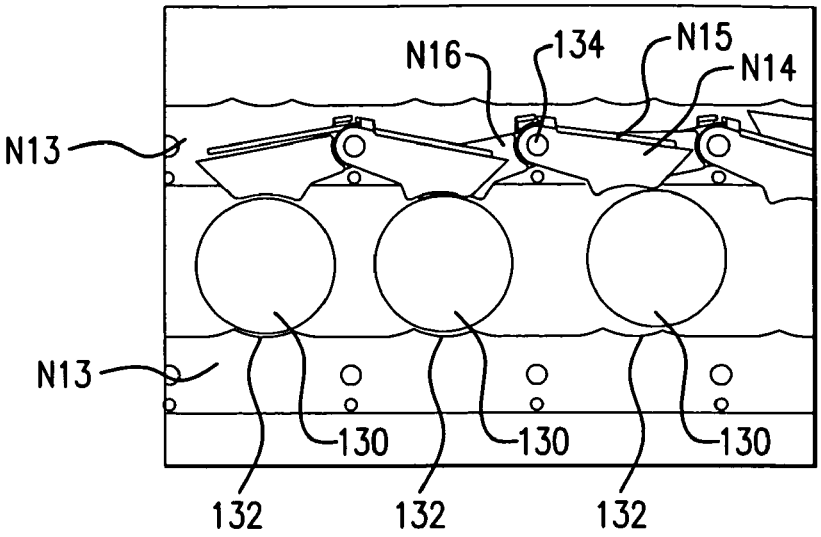
Figure 5I:
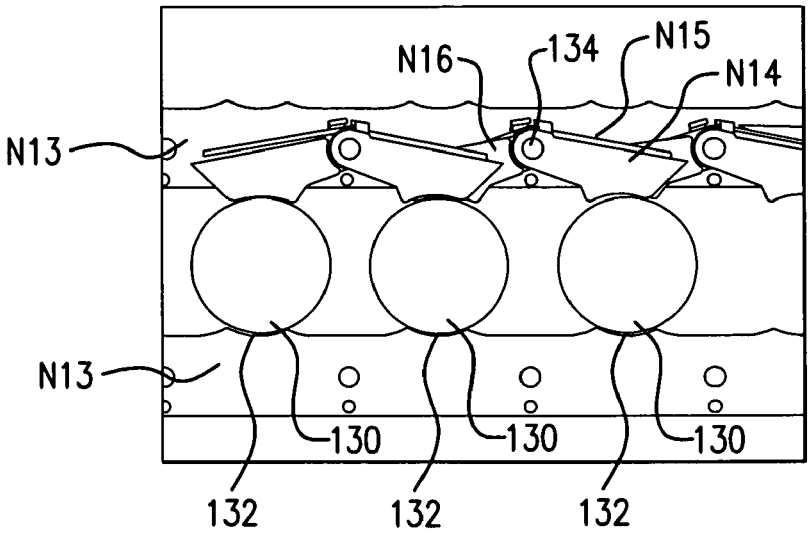
Figure 5J:
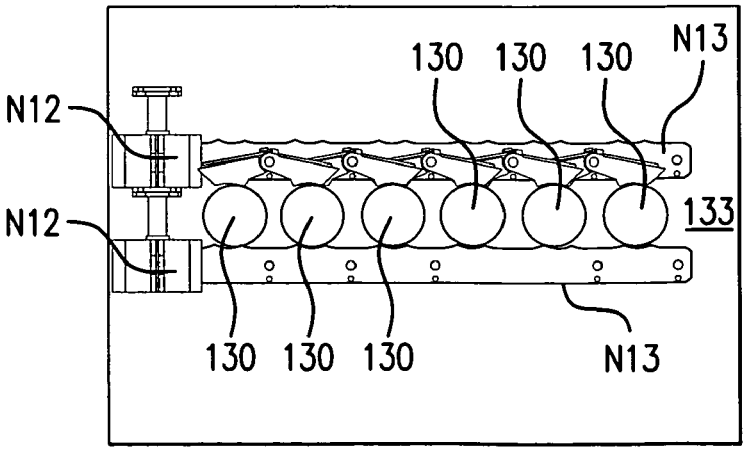
FIG. 5J represents a top plan view of a portion of the rack of the FIG. 1 tripping system after it has been filled with pipes.

If pipe 130 is not the first pipe being inserted between two adjacent finger members N13, the presence of a previously racked pipe 130 will require spring N15 to flex to allow toggle lock N14 to pivot out of the way, as shown in FIG. 5H. Once pipe 130 reaches its final racking position, toggle lock N14 will be forced back toward pipe 130 to retain pipe 130 in its final racking position, as shown in FIG. 5I, and the corresponding toggle lock N16 will assist in retaining the previously racked pipe 130 in its racking position. Once pipe 130 reaches its final location, the bias forces provided by springs N15 cause pipe 130 to be retained between the concave portions 136 of the toggle locks N14, N16 and a particular concave portion 132 on the opposing finger member N13. At the ends of finger members N13, a pipe 130 may be retained by a single toggle lock N14 or by a single toggle lock N16. FIG. 5J shows a portion of pipe rack N5 filled with pipes 130. In some embodiments, toggle locks N14, N16 are provided with locking mechanisms (not shown) which allow them to lock once they receive pipes 130, such that toggle locks N14, N16 are prevented from pivoting when locked. Removal of pipes 130 from pipe rack N5 requires overcoming the bias forces of springs N15 and biasing mechanism 137 on toggle locks N14, N16, and may be accomplished by sequentially pulling pipes 130 toward open end 133, starting with the pipe 130 closest to open end 133.

Figure 6A:
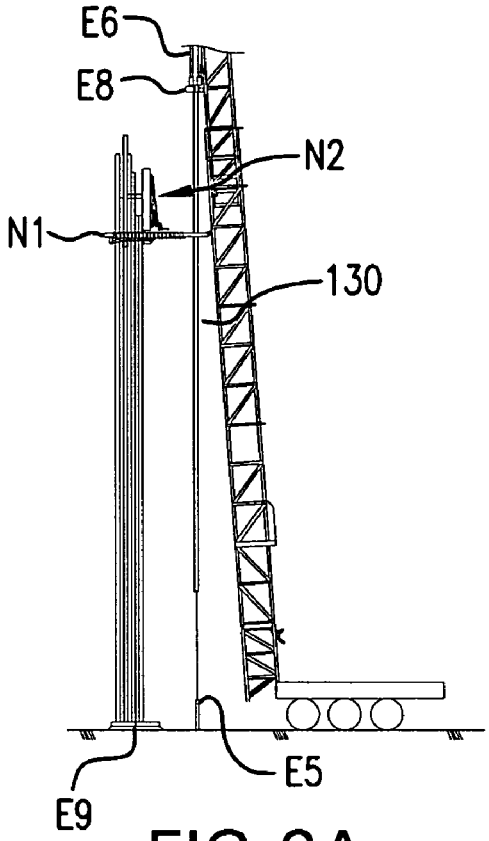
FIGS. 6A, 6B and 6C schematically depict the steps involved in a tripping out operation according to a particular embodiment of the invention.
Figure 6B:
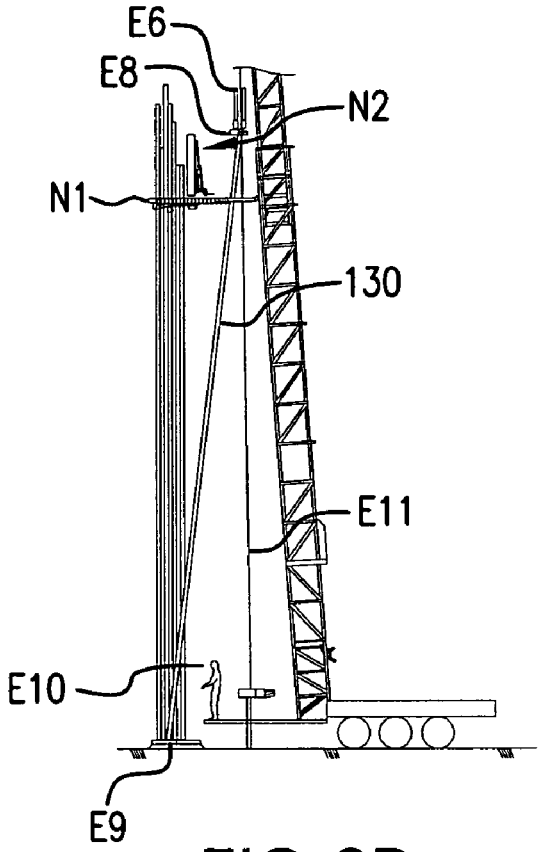
Figure 6C:
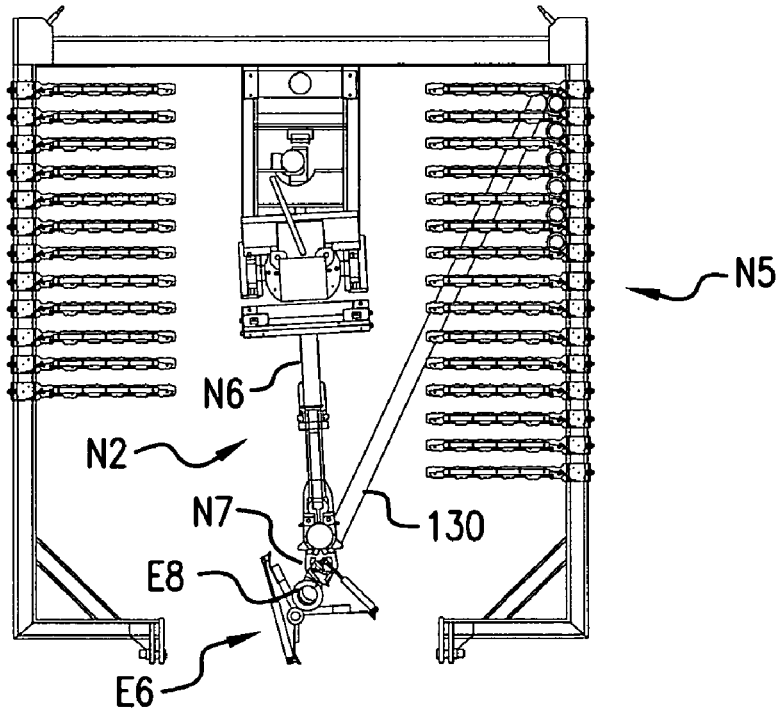

Referring to FIGS. 6A, 6B and 6C, the tripping out (removal) of oil piping may proceed as follows in embodiments which comprise a visual serving system, as described further below. First, elevator E6 is lowered to well head E5 and pipe coupler E8 is coupled onto a pipe 130 at or near its upper end. Elevator mechanism E6 is then drawn upwardly and with it pipe 130 (as shown in FIG. 6A), until the lower end of pipe 130 is clear of well head E5. Next, a human drill head operator E10 latches a rotary actuator (not shown) onto pipe 130 at or near its lower end. The rotary actuator then unscrews pipe 130 from the pipe remaining in the well. Next, operator E10 disengages the rotary actuator from pipe 130, leaving the lower end of pipe 130 free to move. Operator E10 then guides the lower end of pipe 130 over a drip tray E9 and lowers elevator E6, as shown in FIG. 6B. When the lower end of pipe 130 is positioned over the drip tray E9, the orientation of pipe 130 is no longer vertical.

Next, robotic system N2 uses a visual serving system (not specifically enumerated) to locate the upper end of pipe 130 and to autonomously and controllably position robotic system N2, arm N6 and/or end effector N7, such that end effector N7 is disposed to grip pipe 130 at or near its upper end. End effector N7 then securely engages pipe 130, as shown in FIG. 6C. Once end effector N7 has securely engaged pipe 130, pipe coupler E8 is disengaged from pipe 130. Robotic system N2, arm N6 and/or end effector N7 are then moved so that the upper end of pipe 130 is placed into pipe rack N5. The visual serving system, which allows robotic system N2 to locate the upper end of pipe 130 and to position end effector N7 in a location where it can grip pipe 130, is explained in more detail below.

Figure 7A:
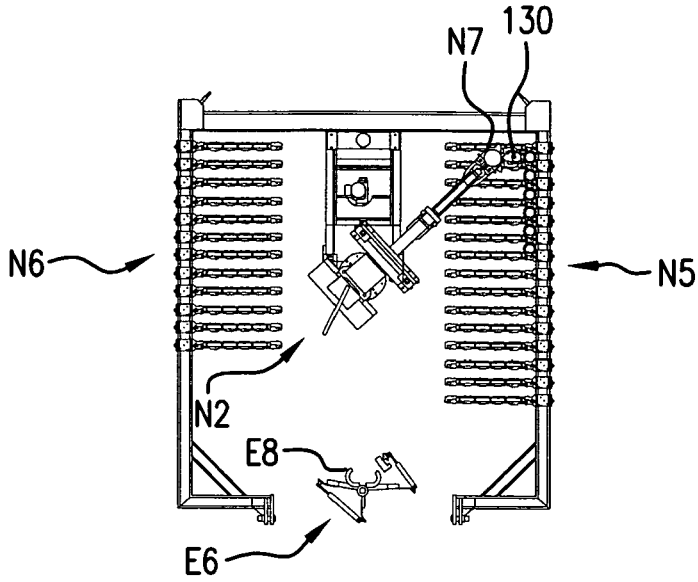
FIGS. 7A, 7B and 7C schematically depict the steps involved in a tripping in operation according to a particular embodiment of the invention.
Figure 7B:
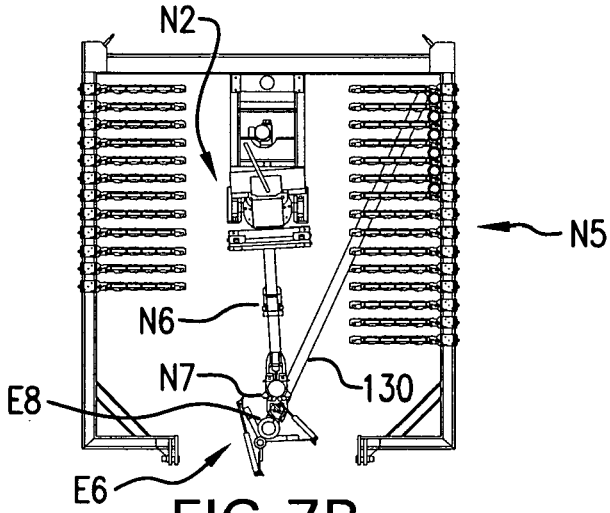
Figure 7C:
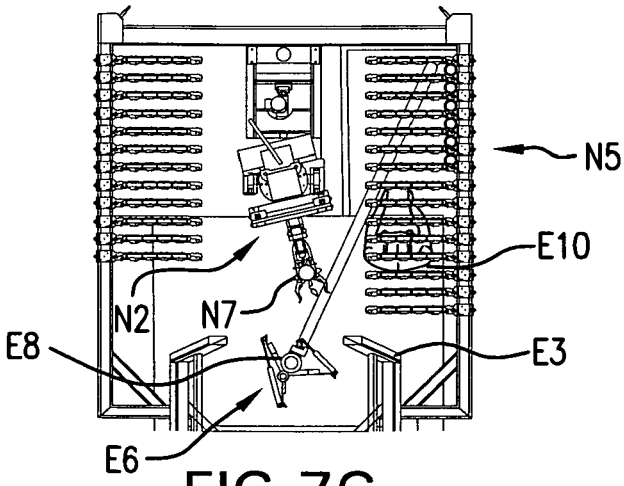

Referring to FIGS. 1, 7A, 7B and 7C, the tripping in (insertion) of oil piping may proceeds as follows. First, robotic system N2, arm N6 and/or end effector N7 are autonomously manipulated so that end effector N7 is positioned to grip a pipe 130 held in pipe rack N5. Once end effector N7 is positioned in this manner, end effector N7 securely engages pipe 130, as shown in FIG. 7A. Robotic system N2 then disengages pipe 130 from pipe rack N5. Robotic system N2, arm N6 and/or end effector N7 are then autonomously moved so that the upper end of pipe 130 is brought into vertical alignment with the axis E11 of elevator E6. Next, elevator E6 is lowered and pipe coupler E8 is coupled onto pipe 130 at or near its upper end, as shown in FIG. 7B. Once pipe coupler E8 is securely attached to pipe 130, end effector N7 is disengaged from pipe 130, as shown in FIG. 7C. Operator E10 then moves the bottom of pipe 130 from drip tray E9 into alignment with another pipe disposed inside the well. Next, operator E10 latches the rotary actuator onto the lower end of pipe 130. The rotary actuator screws pipe 130 onto the pipe already inside the well. Operator E10 then disengages the rotary actuator from pipe 130 and lowers elevator E6 and pipe 130 into the well to complete the tripping in operation.

As discussed briefly above, in some embodiments, oil well tripping system 10 makes use of a machine vision system for autonomously controlling the movement of robotic system N2. The following paragraphs describe an example machine vision system according to a particular embodiment, but it is to be understood that different machine vision systems could be used with system 10. In other embodiments, system 10 may be used without a machine vision system, as described further below.

Figure 8:
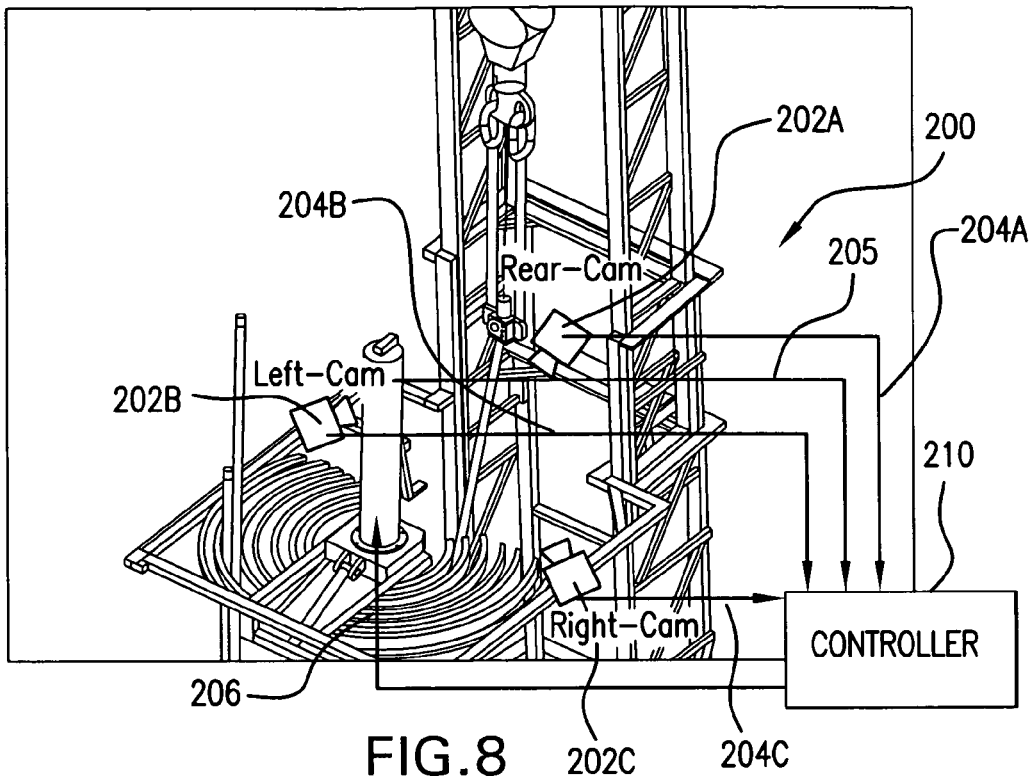
FIG. 8 schematically depicts an image sensing and robot control system according to a particular embodiment of the invention.
Figure 9:
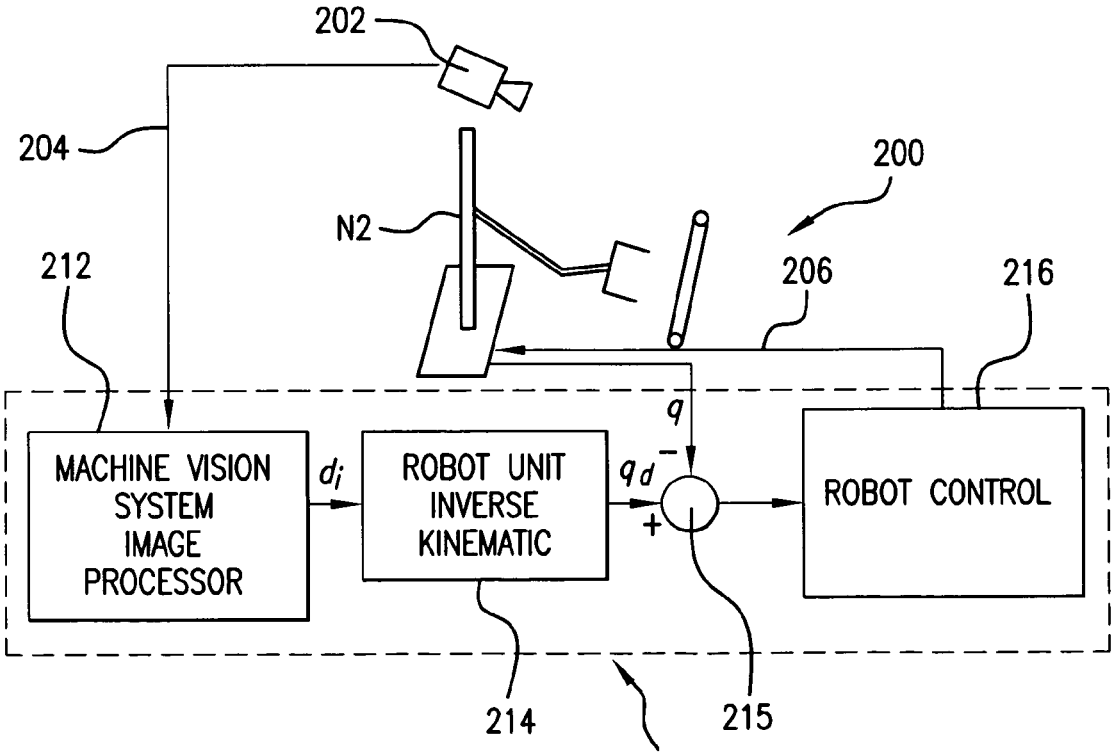
FIG. 9 schematically depicts other elements of the FIG. 8 system.

FIGS. 8 and 9 schematically depict a machine vision and robot control system 200 according to a particular embodiment of the invention. The rack (not specifically enumerated) shown in FIG. 8 is different from rack N5 shown in FIGS. 1-5C. The rack of FIG. 8 comprises concentric arc-shaped finger members (not specifically enumerated) which allow the insertion of pipe 130 into the FIG. 8 rack by pivotal movement of robotic system N2 about pivot joint N8 (see FIG. 2B). In the illustrated embodiment system 200 comprises an image sensing system 202 and a controller 210. Imaging sensing system 202 obtains image data 204 and provides image data 204 to controller 210. Controller 210 interprets image data 204 to obtain a target position for end effector N7 during tripping operations. Controller 210 uses image data 204 together with position data 205 from the position sensors associated with robotic system N2 to generate suitable control signals 206 which control the movement of robotic system N2 so that end effector N7 achieves the desired target position.

Image sensing system 202 obtains image data 204 relating to a region in a vicinity of elevator axis E11 above racking platform N1. Pipe 130 is expected to pass through this region during tripping operations. In the illustrated embodiment, image sensing system 202 comprises a plurality of image sensing devices 202A, 202B, 202C. Image sensing devices 202A, 202B, 202C are spaced apart from one another and are oriented to respectively capture image data 204A, 204B, 204C in the region of interest. In one particular embodiment, image sensing devices 202A, 202B, 202C may be digital cameras which make use of arrays of CCD or CMOS or similar optical detectors. In other embodiments, image sensing system may comprise a different numbers of image sensing devices.

In the illustrated embodiment, controller 210 comprises an image processing component 212 which receives image data 204 from image sensing system 202 and generates a target position $d_i$ for end effector N7. Determining the target position $d_i$ of end effector N7 may involve determining the position of the upper end of a pipe 130 in elevator E6 and the orientation of the pipe 130 relative to a known axis (e.g. elevator axis E11 or a horizontal axis). Controller 210 further comprises a robot unit inverse kinematic component 214, which processes target position $d_i$ to obtain a set of desired coordinates $q_d$ for robotic system N2 (in the measurement space of the position sensors of robotic system N2). Comparison component 215 then compares the desired coordinates $q_d$ for robotic system N2 to the actual robot unit coordinates q (i.e. robot unit position data 205 sensed by the sensors of robotic system N2). Robot control component 216 then uses the differences between the actual coordinates q and the desired coordinates $q_d$ to generate appropriate control signals 206 for the actuators of robotic system N2.

Image processing component 212 may perform a number of image manipulation operations prior to (or as a part of) the process of determining the target position $d_t$ of end effector N7. In one particular embodiment, the processing operations performed by image processing component 212 on incoming image data 204 comprise: optionally processing color image data 204 (if necessary) to obtain intensity values of the pixels in the image; determining the mean pixel intensity value of the resultant image; subtracting the mean pixel intensity value from the intensity values the pixels in the image; adding a pixel intensity offset value to the intensity value of the pixels in the image; and applying a low pass filter to the image.

FIGS. 10A-10C depict an example of such image processing. Image data 300 represents the intensity values of image data 204 obtained from image sensing system 202. In some embodiments, image sensing system 202 may directly provide intensity value image data 300. Image data 300 includes a fair amount of background scenery which may make it difficult to determine the location of the end 131 of pipe 130. Image processing component 212 may process image data 300 to obtain image data 302 by: determining a mean intensity value of image data 300; subtracting the mean intensity value from image data 300; and adding an offset threshold value to reduce the darkness of the resultant image data. Image data 302 is then further processed to obtain image 304 by applying a low pass filter to "smooth out" the image. In one particular embodiment, the low pass filter is a Gaussian filter. It can be seen that background scenery is largely eliminated from image data 304.

In some embodiments, image processing component 212 makes use of a feature detection process which operates on a projection of the image data to determine the position of the end 131 of pipe 130. Preferably, this feature detection process operates on one or more projections of background-reduced image data 304. The projections on which image processing component 212 performs the feature detection process may be horizontal, vertical or arbitrary projections. These projections may be determined on the basis of the field of view of the image, which may in turn depend on the position and orientation of the images sensors 202A, 20B, 20C and an approximate expected position of pipe 130. To reduce processing time, image processing component 212 may identify a region of interest from within image data 304 based on an approximate expected position of pipe 130 and perform the feature detection process only on data from the region of interest.

Figure 11B:
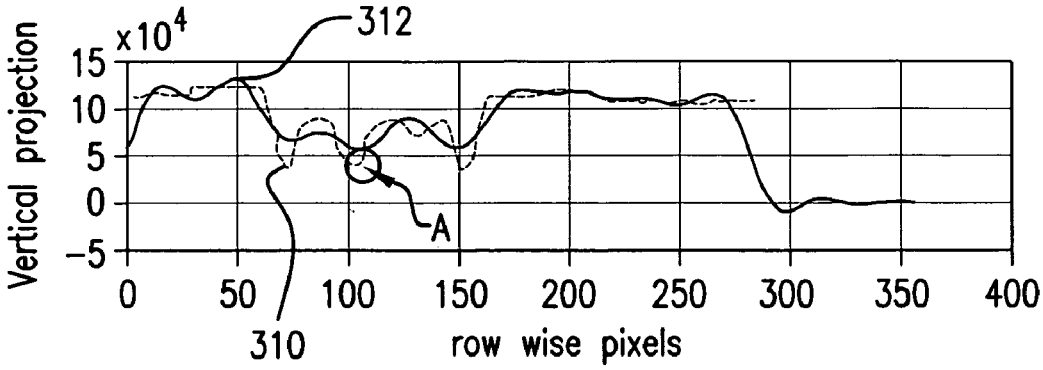

FIGS. 11A-11D schematically depict a feature detection process for determining the position of the end 131 of a pipe 130 according to a particular embodiment of the invention. FIG. 11A depicts image data 304 which has been processed to remove the background scenery as discussed above. Advantageously, when applied to an oil well tripping system, the top 131 of pipe 130 can be expected to pass through a region of interest 306 which represents a portion of image data 304. Consequently, the feature detection process used to detect the top 13 of pipe 130 may be limited to image data within region of interest 306.

FIG. 11B depicts a plot 310 (in dashed lines) showing the result of a vertical projection wherein region of interest 306 is divided into vertical columns and the intensities of all of the pixels in each column are added to arrive at a vertical projection value. Columns exhibiting a large number of high intensity (white) pixels will have high vertical projections values, whereas columns exhibiting a large number of low intensity (black) pixels will have low vertical projection values. In the illustrated embodiment, each vertical column is one pixel wide. Accordingly, region of interest 306 is approximately 350 pixels wide (i.e. plot 310 spans 350 vertical projection columns). In other embodiments, each column has a width comprising a plurality of pixels. Plot 310 may be low pass filtered to arrive at plot 312 (in solid line). In one particular embodiment, the low pass filter used to generate plot 312 is a kaiser filter having a passband of 0-900 Hz and a cut-off frequency of 2.5 kHz.

It can be seen from plots 310 and 312 that the vertical projection exhibits three local minima which correspond to elevator components 308A, 308B and to pipe 130. Controller 210 may interpret the central local minimum A to represent an approximation of a vertical axis 314 of pipe 130. Image processing component 212 may make use of a minima detection algorithm to detect the central local minimum A. In some embodiments, elevator components 308A, 308B may be different. Those skilled in the art will appreciate that feature detection processes may differ where the expected features of the image (e.g. elevator components 308A, 308B) are different.

Figure 11C:
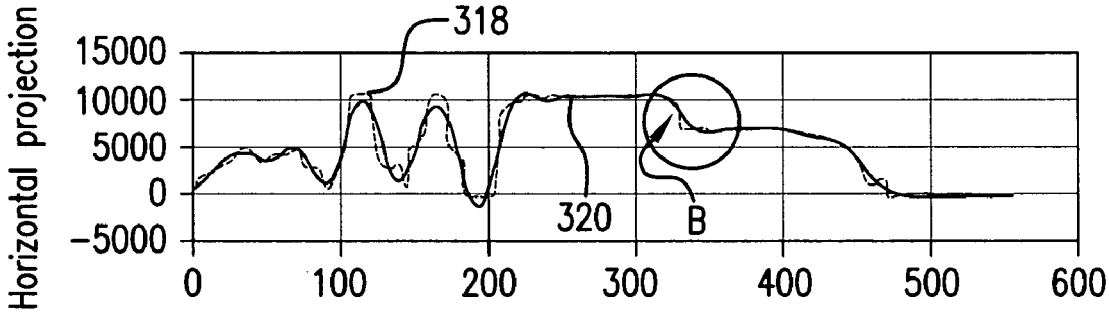

FIG. 11C depicts a plot 318 (in dashed lines) showing the result of a horizontal projection wherein region of interest 306 is divided into horizontal rows and the intensities of all of the pixels in each row are added to arrive at a horizontal projection value. In the illustrated embodiment, each horizontal column is one pixel in height. Accordingly, region of interest 306 is approximately 550 pixels high (i.e. plot 318 spans 550 horizontal projection rows). In other embodiments, each row has a height comprising a plurality of pixels. Plot 318 may be low pass filtered to arrive at plot 320 (in solid line). The low pass filter may be the same as that used to generate the vertical projections.

Figure 11D:
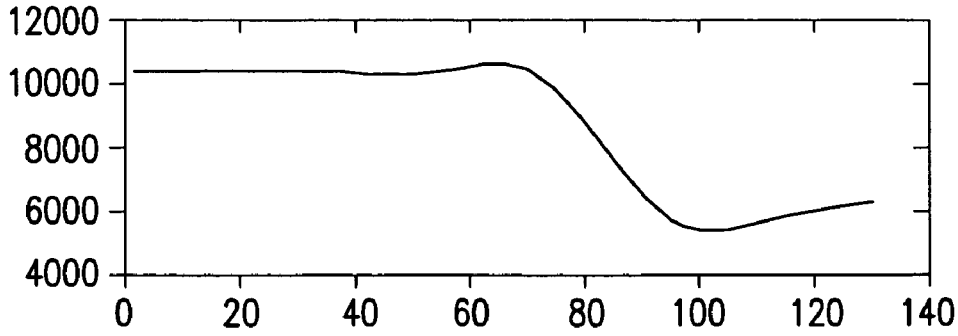
FIG. 11D is a plot showing a curvelet which may be convolved with the FIG. 11C horizontal projections to determine the vertical position of the top of the pipe.

In FIG. 11C, plot 320 exhibits a noticeable decay in region B, which corresponds to the vertical end 316 of pipe 130. In one particular embodiment, the region B decay is detected by convolving the plot 320 horizontal projection with a curvelet representing an idealized decay signal. Convolution is well known to those skilled in the art of digital signal processing. FIG. 11D exhibits such an idealized decay curvelet. The point along plot 320 where this convolution is a maximum may be selected as the vertical end 316 of pipe 130.

FIGS. 10-11D and the discussion presented above represent one embodiment of the signal processing of image processing component 212 for the image data corresponding to a single image sensor 202A, 202B, 202C. Those skilled in the art will appreciate that the same types of processing may occur for image data captured by other image sensors 202A, 202B, 202C to capture three-dimensional information about the location of the top 131 of pipe 130 and/or to add additional data to an estimate of the location of the top 131 of pipe 130. The top 131 of pipe 130 may be used by controller 200 to determine the desired position $d_t$ of end effector N7 during tripping operations.

In accordance with another embodiment of the invention, image processing component 212 performs a cross-correlation template matching operation between a selected subset of the image pixels and an idealized image (a template) containing the top 131 of pipe 130. The general cross-correlation between two functions f and g is given by:

$$f \otimes g = \int_{-\infty}^{\infty}\int_{-\infty}^{\infty} f(u, v)g(u+x, v+y)\,du\,dv$$

and the normalized cross-correlation is given by:

$$\frac{f \otimes g}{\sqrt{\iint f^2 \cdot \iint g^2}} \leq 1$$

Generalizing this to two-dimensional discrete functions $I_{ij}$ and $B_{ij}$, the cross-correlation r is given by:

$$r = \frac{\sum_i \sum_j (I_{ij} - \bar{I}_{ij})(B_{ij} - \bar{B}_{ij})}{\sqrt{\sum_i \sum_j (I_{ij} - \bar{I}_{ij})^2 \sum_i \sum_j (B_{ij} - \bar{B}_{ij})^2}}$$

Here, r takes on a value between [−1,1] which can be used as a measure of a similarity between a selected portion of image data 204 ($I_{ij}$) and data associated with an idealized template image ($B_{ij}$) containing the top 131 of pipe 130.

Figure 12:
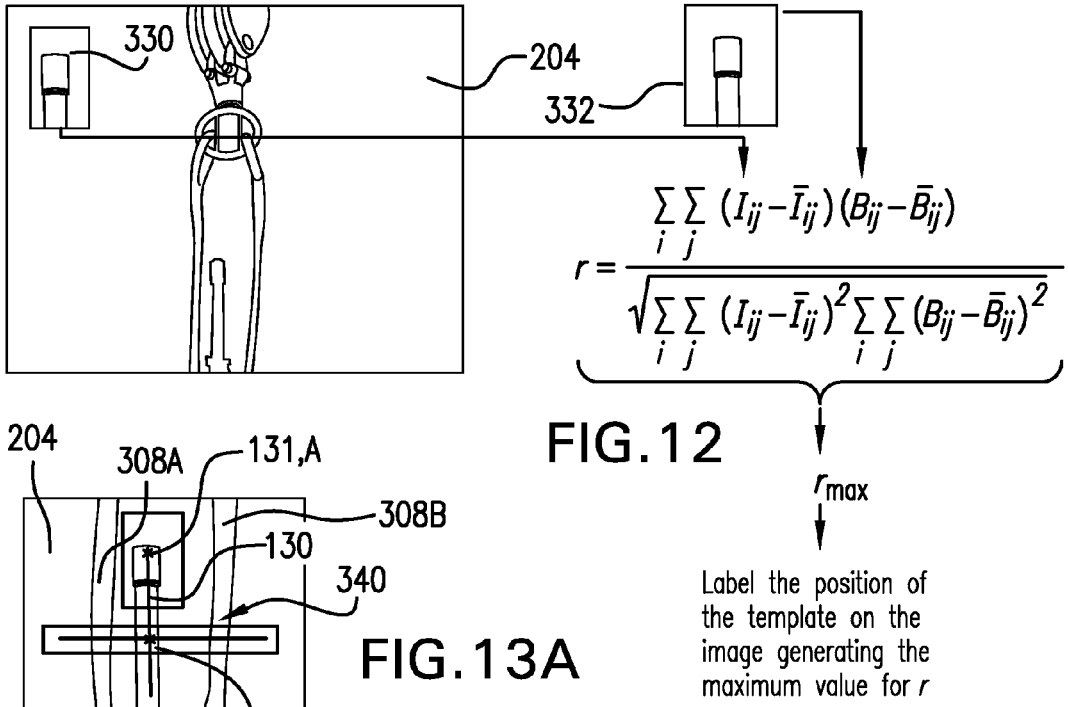
FIG. 12 is a schematic depiction of a cross-correlation template matching technique for locating the top of a pipe according to a particular embodiment of the invention.

FIG. 12 schematically depicts how this cross-correlation function r can be used to detect a location of the top 131 of pipe 130 within image data 204. Image data 204 is parsed into a plurality of two-dimensional image portions 330. Image processing component 212 computes a cross-correlation r between the pixels ($I_{ij}$) of each portion 330 and the pixels ($B_{ij}$) of a template image 332 containing the top 131 of pipe 130. The portion 330 of image data 204 that exhibits the highest cross-correlation r with template image 332 (i.e. most closely matches template image 332) is assumed to contain the top 131 of the pipe 130.

Advantageously, this cross-correlation template matching technique does not require that background scenery be removed from image data 204 (i.e. the preprocessing steps of FIG. 10 are not required). However, in some circumstances, such as different light conditions (brightness and contrast) for example, image preprocessing can be useful to improve the accuracy and reliability of this cross-correlation template matching technique. As with the feature detection technique of FIGS. 10A-10C and 11A-11D, the computational resources consumed by this cross-correlation feature matching technique may be reduced by performing the operation over a region of interest that occupies a subset of image data 204 (see region of interest 306 of FIG. 11A).

One variable which can impact this cross-correlation template matching technique is the size of the horizontal and vertical jumps between neighboring image portions 330. For example, if the top left corner of a first image portion 330 is at pixel (1,1), then a subsequent image portion 330 may have a horizontal jump which may be as small as one pixel (i.e. a top left corner at pixel (2,1)) or the subsequent image portion may have a larger horizontal jump. Similarly, the vertical jump to a subsequent image portion 330 may be as small as one pixel (i.e. a top left corner at pixel (1,2)) or the vertical jump to the subsequent image portion 330 may be larger. It will be appreciated that larger horizontal and vertical jumps will result in a faster computation time, but may be more apt to lead to spurious results. In some embodiments, the horizontal and vertical jumps are in a range of [1, 10]. In other embodiments, the horizontal and vertical jumps are in a range of [1, 4]. In some embodiments, the cross-correlation template matching process is performed in a number of iterations, wherein the horizontal and vertical jumps and the region of interest are decreased for each successive iteration.

Other variables that influence this cross-correlation template matching process include the possibility that pipe 130 moves off of the axis E11 of elevator E6 (See FIG. 1). If the top 131 of pipe 130 moves away from a particular image sensor, then it will appear smaller in image data 204 than in template image 332. Conversely, if the top 131 of pipe 130 moves toward a particular image sensor, then it will appear larger in image data 204 than in template image 332. This cross-correlation template matching technique has been experimentally determined to reliably detect the top 131 of pipe 130 for size differences of over 25%. A similar complication arises from the fact that pipe 130 may be suspended by elevator E6 at an angle that is different from the angle in which the pipe of template image 332 is suspended. This cross-correlation template matching technique has been experimentally determined to reliably detect the top 131 of pipe 130 for relative image rotation (i.e. between the actual image data 204 and template image 332) of over 5%.

The cross-correlation template matching technique presented above represents one embodiment of the signal processing of image processing component 212 for the image data corresponding to a single image sensor 202A, 202B, 202C. Those skilled in the art will appreciate that the same types of processing may occur for image data captured by other image sensors 202A, 202B, 202C to capture three-dimensional information about the location of the top 131 of pipe 130 and/or to add additional data to an estimate of the location of the top 131 of pipe 130. The top 131 of pipe 130 may be used by controller 200 to determine the desired position $d_t$ of end effector N7.

Image processing component 212 may also determine the angle at which pipe 130 is oriented in order to determine the desired location $d_t$ of end effector N7. It will be appreciated by those skilled in the art that if the location of the top 131 of pipe 130 is known (e.g. using one or more of the techniques discussed above), then determining the location of another point on the axis of pipe 130 will determine the angular orientation of pipe. For example, if the top 131 of pipe 130 is known in two dimensions to have the coordinates ($o_x$, $o_y$) and another point on the axis of the pipe is known to have the coordinates ($v_x$, $v_y$), then the angle of pipe 130 with respect to the horizontal axis is given by $\alpha = \tan^{-1}((o_y - v_y)/(o_x - v_x))$.

Figure 13A:
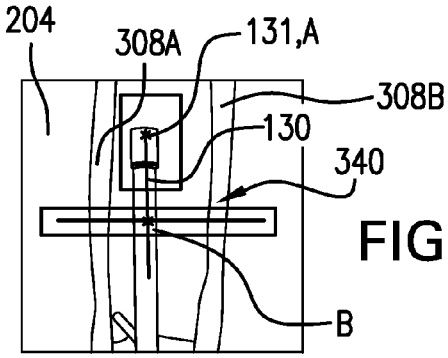
FIGS. 13A, 13B and 13C schematically depict a vertical projection, feature recognition technique for locating a second point on the pipe axis and thereby determining the orientation of the pipe.
Figure 13B:
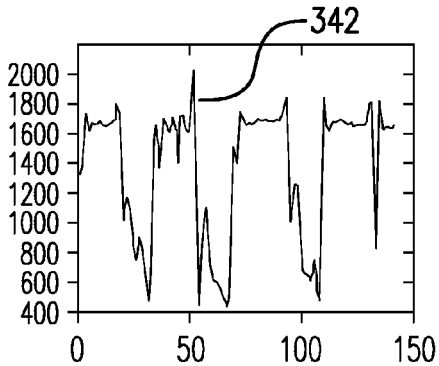
Figure 13C:
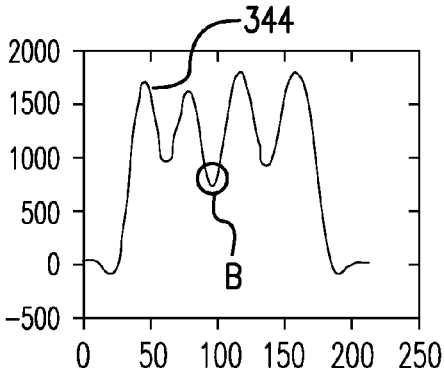

FIGS. 13A-13C schematically depict one technique for obtaining a second point on the axis of pipe 130. It is assumed that the top 131 point A) of pipe 130 has been determined (e.g. in accordance with one of the aforementioned techniques). Determining a second point B on the axis of pipe 130 may be accomplished using a vertical projection, feature recognition technique similar to that shown in FIG. 11B. The vertical projections may be created by: creating a reduced size two-dimensional matrix 340 which is spaced below the top 131 (point A) of pipe 130 by a fixed amount; dividing matrix 340 into vertical columns; and adding the values of all of the pixels in each column. Preferably, matrix 340 is relatively small, particularly in the vertical dimension. In the illustrated embodiment, matrix 340 is 10 pixels high by 140 pixels wide.

FIG. 13B shows a vertical projection plot 342 similar to the vertical projection plot 310 of FIG. 1B. FIG. 13C shows a plot 344 which is a low pass filtered version of plot 342. FIG. 13C shows that plot 344 comprises three local minima. The first and third minima correspond to elevator components 308A, 308B and the central minimum corresponds to point B on pipe 130. Image processing component 212 may comprise a local minimum detection algorithm to locate the local minimum corresponding to point B. In other embodiments, features other than local minima can be used to detect point B on pipe 130. For example, vertical projection plot 324 may be convolved with an idealized curvelet to detect point B. Once the location of point B on pipe 130 is known, then image processing component 212 may determine the angle of orientation of pipe 130 as discussed above.

It will be appreciated by those skilled in the art that signal preprocessing steps similar to those of FIGS. 10A-10C may be used to increase the accuracy of the vertical projection, feature detection technique of FIGS. 13A-13C and to thereby increase the accuracy of the location of point B. Such preprocessing can be performed on the entire image or on the reduced size matrix 340. In cases where the top 131 (point A) of pipe 130 is determined by a cross-correlation template matching technique (FIG. 12), a vertical projection, feature detection technique (similar to FIGS. 13A-13C) may be performed on a reduced size matrix to refine the location of the top 131 (point A) of pipe 130.

Figure 14A:
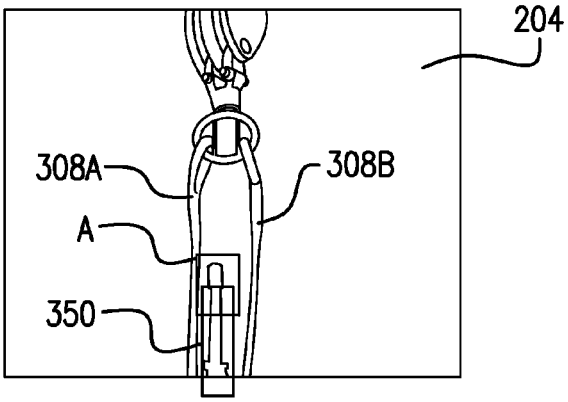
FIGS. 14A-14C schematically depict an edge detection process that may be used to generate binary edge detection information for inputting into a Hough transform.
Figure 14B:
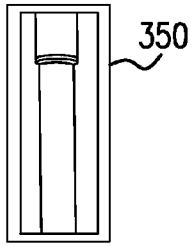
Figure 14C:
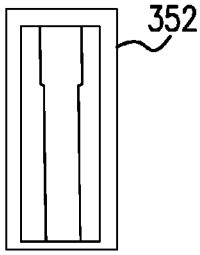

In accordance with another embodiment of the invention, an edge detection technique combined with a Hough transform is used to locate a second point (point B) on the axis of pipe 130. FIGS. 14A-14C schematically depict how a subset 350 of image 204 is extracted for edge detection. Subset 350 is preferably a relatively narrow matrix of pixels having an upper vertical boundary that corresponds (approximately) with the top 131 (point A) of pipe 130. Subset 350 should be centered horizontally at point A and relatively narrow in width, so as not to include the other edges of elevator components 308A, 308B. Such extraneous edges may make it difficult for the Hough transform to accurately determine the angle of orientation of pipe 130. Subset 350 is subjected to an edge detection process to generate a binary image 352. The edge detection process may be a Roberts Cross, Sobel or Canny edge detection process. These and other edge detection processes are known in the art.

The use of a Hough transform to detect the angle of straight line(s) from binary edge detection data is known. In one particular embodiment, the Hough transform used for this process is the parametric transformation $\rho = x \cos\theta + y \sin\theta$. This parametric transformation maps points $(x_i, y_i)$ in binary edge detection data 352 into sinusoidal curves in the Hough domain $(\rho, \theta)$. Points $(x_i, y_i)$ that are co-linear in edge detection data 352 will intersect at a particular point $(\rho, \theta)$ in the Hough domain. This Hough angle $\theta$ may then be used to detect the angle $\alpha$ formed by pipe 130 with the horizontal axis according to $\alpha = 90° - \theta$.

Edge detection data 352 exhibits two straight lines corresponding to the edges of pipe 130. This edge detection data 352 may generate two sets of curves in the Hough domain. Ideally, the members of the first set of curves should intersect one another in the Hough domain at points $(\rho_1, \theta_1)$ and the second set of curves should intersect one another in the Hough domain at points $(\rho_2, \theta_2)$. However, since the edges of pipe 130 are generally parallel, $\theta_1$ should be substantially similar to $\theta_2$. In some embodiments, the Hough transformation process is carried on both edges of pipe 130. In other embodiments, the Hough transformation process need only be carried out on a single edge. As is known in the art, the Hough domain may be divided into accumulator cells and peaks in these accumulator cells may be interpreted as strong evidence that a straight line exists in edge detection data 352 which has Hough domain parameters within the accumulator cell.

Once the top 131 of pipe 130 and the orientation of pipe 130 are known, then image processing component 212 can use these parameters of pipe 130 to determine the target position $d_t$ of end effector N7 such that end effector N7 can interact with pipe 130. This desired position $d_t$ can then be used by robot unit inverse kinematic component 214 and robot control component 216 to generate appropriate control signals 206 for the actuators of robotic system N2 as described above (see FIG. 8).

It may also be useful for controller 210 to use image data 204 to determine abrupt changes in acceleration of pipe 130. Such abrupt changes can be indicative of pipe being lowered by elevator E6 into drip tray E9 and the bottom of pipe 130 impacting drip tray E9. Once the bottom of pipe 130 impacts drip tray E9 (e.g. during a tripping out process), then robotic system N2 can be manipulated to make end effector N7 grip pipe 130.

Abrupt changes in acceleration of pipe 130 may be detected using a vertical projection feature detection technique (similar to that of FIG. 11B), but on a different region of interest. Such a technique is schematically depicted in FIGS. 15A-15G.

Figure 15A:
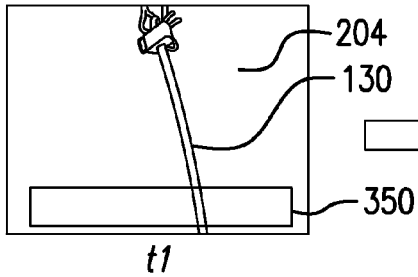
FIGS. 15A-15G schematically depict a technique for determining sudden changes in acceleration which may be indicative of the bottom of the pipe impacting the drip tray.
Figure 15B:
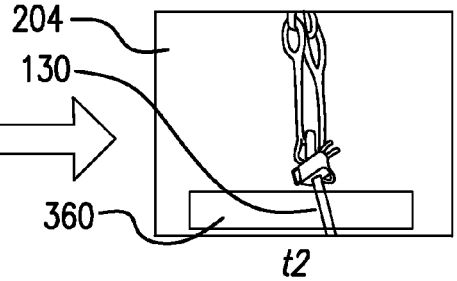
Figure 15C:
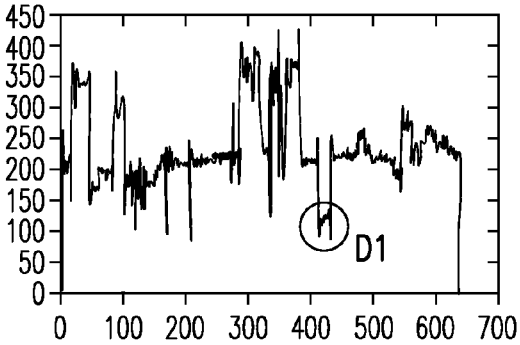
Figure 15D:
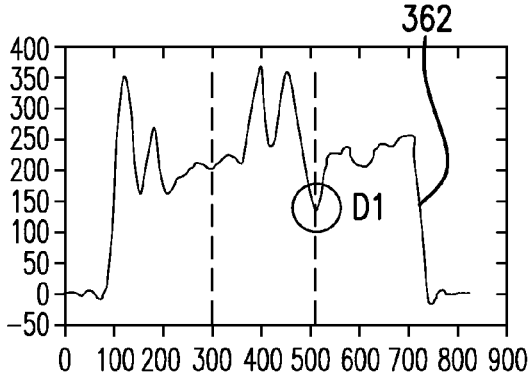

FIGS. 15A-15B show image data 204 between time t1 and a later time t2, between which elevator E6 is lowering pipe 130. Region of interest 360 is at the lower end of image 204, where the body of pipe 130 is distinct from the components of elevator E6. A vertical projection technique may be used on region of interest 360 to determine the location of the body of pipe 130.

Figure 15E:
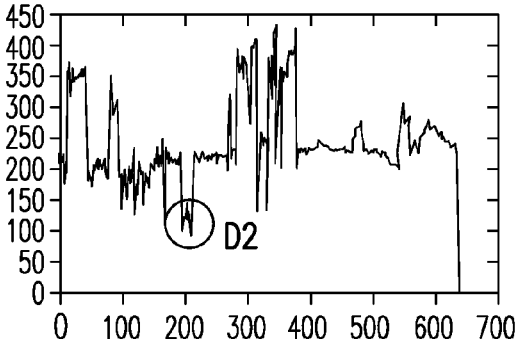
Figure 15F:
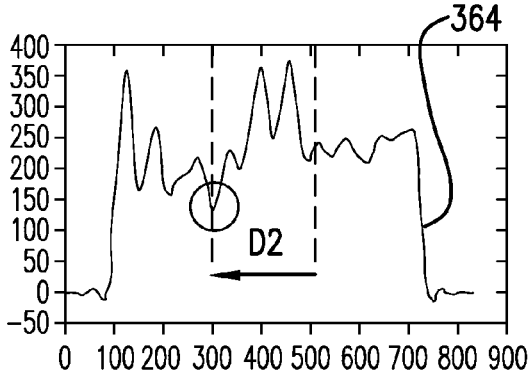
Figure 15G:
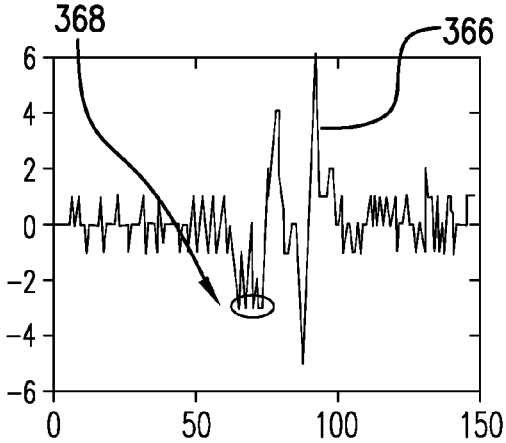

FIGS. 15C-15F show a low pass filtered vertical projection plot 362 taken at time t1. The body of pipe 130 is determined to be located at local minimum D1. FIGS. 15E-15F also show a low pass filtered vertical projection plot 364 taken at time t2. At time t2, the body of pipe 130 is determined to be located at local minimum D2. Preprocessing similar to that of FIGS. 10A-10C may be used before implementing these vertical projections. A minima detection algorithm or other feature detection process may be used to locate points D1 and D2. Data from plots 362, 364 may be used to calculate the acceleration of pipe 130 over time. FIG. 15G shows a plot 366 of the acceleration of pipe 130 over time. Region 368 of plot 366 shows a distinct change in acceleration of pipe 130. Accordingly, region 368 may be interpreted as being the time where pipe 130 hits drip tray E9. The calculated acceleration may be subject to a thresholding process to determine the time that pipe 130 impacts drip tray E9.

Figure 16A:
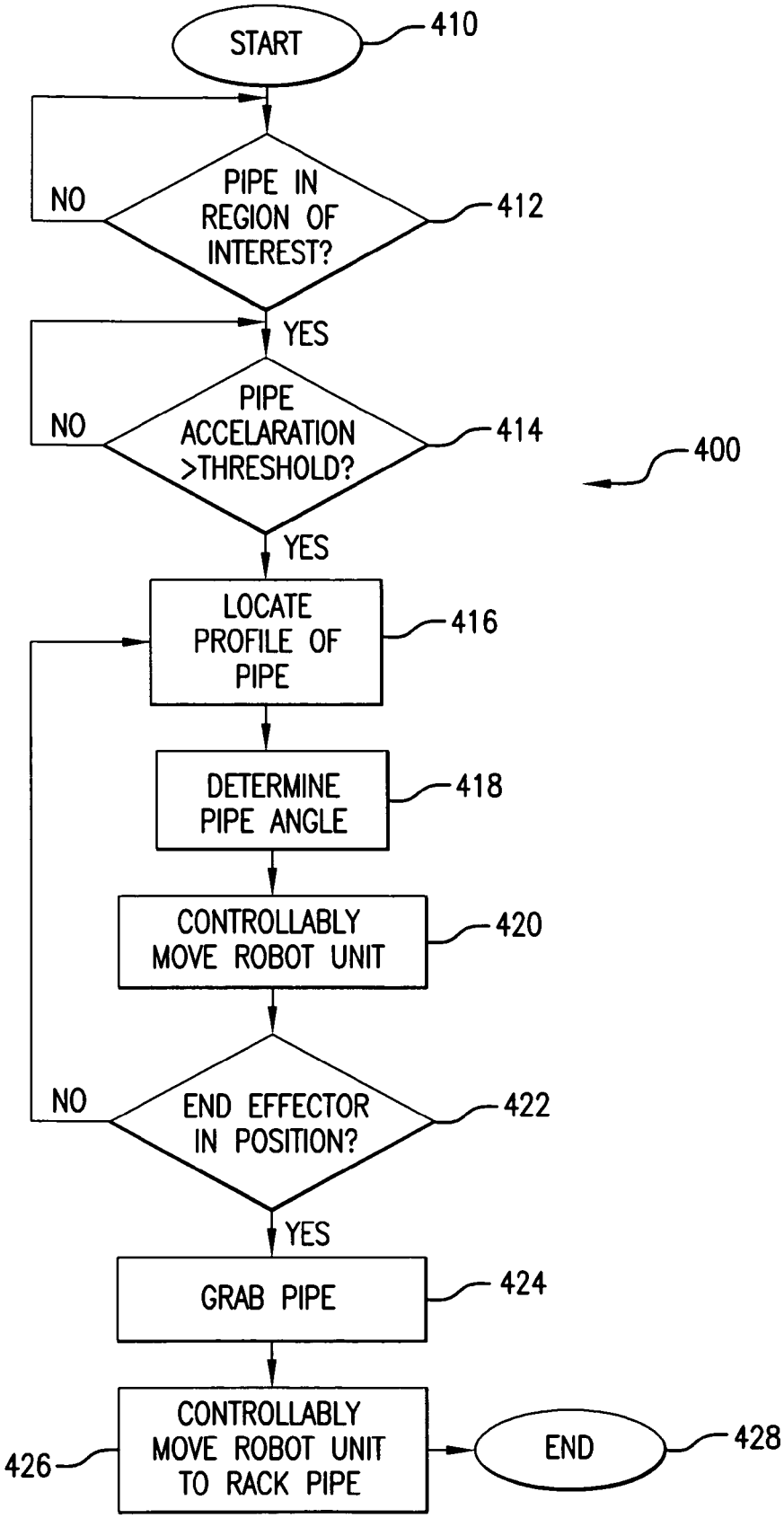
FIG. 16A depicts a method for tripping out a pipe according to a particular embodiment of the invention.

FIG. 16A schematically depicts a method 400 of tripping out a pipe 130 according to a particular embodiment of the invention. Method 400 commences in block 410 and proceeds to block 412, where controller 210 determines whether a pipe 130 is within the field of view of image sensing system 202. This block 412 determination may be made by processing image data 204 from image sensing system 202, by interpreting data from some other sensor (e.g. a sensor on elevator E6 which determines when pipe coupler E8 has passed above racking platform N1) or by input of operator E10. If there is a pipe 130 within the field of view of imaging system 202 (block 412 YES output), then method 400 proceeds to block 414 where control system 200 waits for a sudden change in acceleration. The determination of a sudden change in acceleration may be based on image data 204 and may be made using a thresholding process, as described above. If a sudden change of acceleration is detected (block 414 YES output), then system 200 may interpret this as operator E10 manipulating the bottom of pipe 130 into drip tray E9. Method 400 then proceeds to block 416.

Blocks 416, 418 and 420 involve using image data 204 from image sensing system 202 to determine the location of the profile of pipe 130 (block 416), to determine the orientation of pipe 130 (block 418) and, on the basis of this information in combination with information from the sensors associated with robotic system N2, to controllably move robotic system N2 (block 420) such that end effector N7 moves toward a position where in can grab pipe 130. This process may involve determining a target position for end effector N7 and moving robotic system N2, so as to move end effector N7 toward this target position. The target position for end effector N7 is preferably dynamically updated using information from image sensing system 202. When end effector is properly positioned to grab pipe 130 (block 422 YES output), then controller 210 causes end effector N7 to grab pipe 130 in block 424. In block 426, controller 210 causes robotic system N2 to controllably move end effector N7 to an appropriate location in rack N5 and to release pipe 130 in rack N5. Movement of robotic system N2 in block 426 may be done without feedback from image sensing system 202.

Figure 16B:
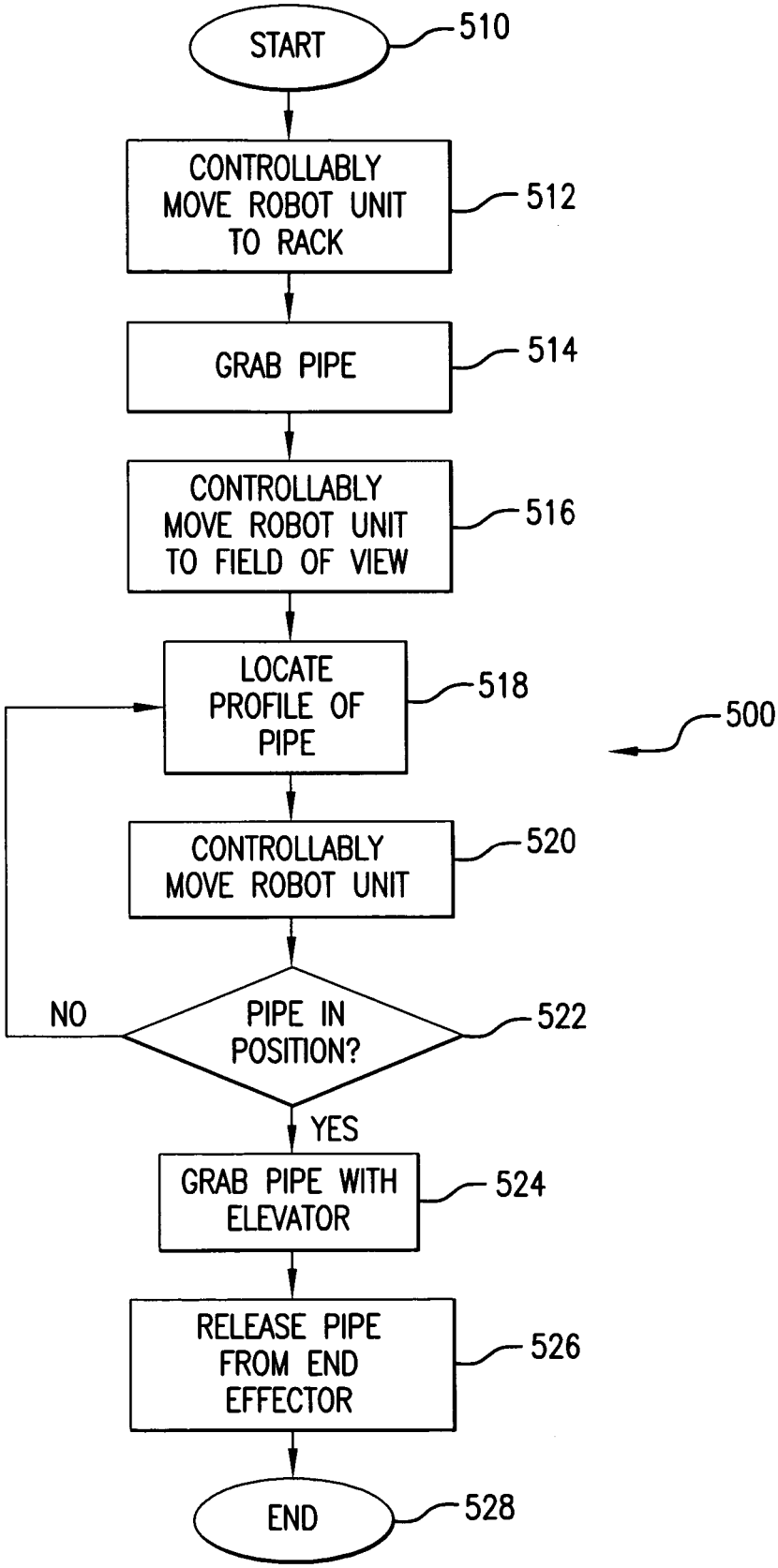
FIG. 16B depicts a method for tripping in a pipe according to a particular embodiment of the invention.

FIG. 16B schematically depicts a method 500 for tripping in a pipe 130 according to a particular embodiment of the invention. Method starts in block 510 and then moves to block 512, where controller 210 causes robotic system N2 to move such that end effector N7 is in position to grab a pipe 130 from rack N5. Controller 210 then causes end effector N7 to grab a pipe in block 514 and begins to move robotic system N2 toward the field of view of image sensing system 202 in block 516. Movement of robotic system N2 in blocks 510 and 514 may occur without feedback from image sensing system 202. Once pipe 130 is located in the field of view of image sensing system 202, then image data 204 is obtained and controller 210 uses this image data in combination with information from the sensors associated with robotic system N2 to move the top of pipe 130 into alignment with the axis E11 of elevator E6.

In the illustrated embodiment, controller 210 determines the location of the profile of pipe 130 using image data 204 (in block 518) and causes robotic system N2 to move end effector N7 in response to this information in combination with information from the sensors associated with robotic system N2 (in block 520). In the block 522 movement of robotic system N2, the target position of end effector N7 may be the target position required to place the top of pipe 130 in alignment with elevator axis E11. This target position may be dynamically updated on the basis of image data 204. When it is determined (based on image data 204) that the top of pipe 130 is located in alignment with axis E11 of elevator E6 (block 522 YES output), then elevator E6 grabs pipe 130 in block 524. Once elevator E6 has grabbed pipe 130, then controller 210 may cause end effector N7 to release pipe 130 in block 526. Pipe 130 can then be lowered into the oil well by elevator E6.

As briefly discussed above, in some embodiments system 10 may be used without any machine vision system. An example of the operation of such an embodiment is discussed in the following paragraphs with reference to FIGS. 17, 18 and 19A-C.

Figure 17:
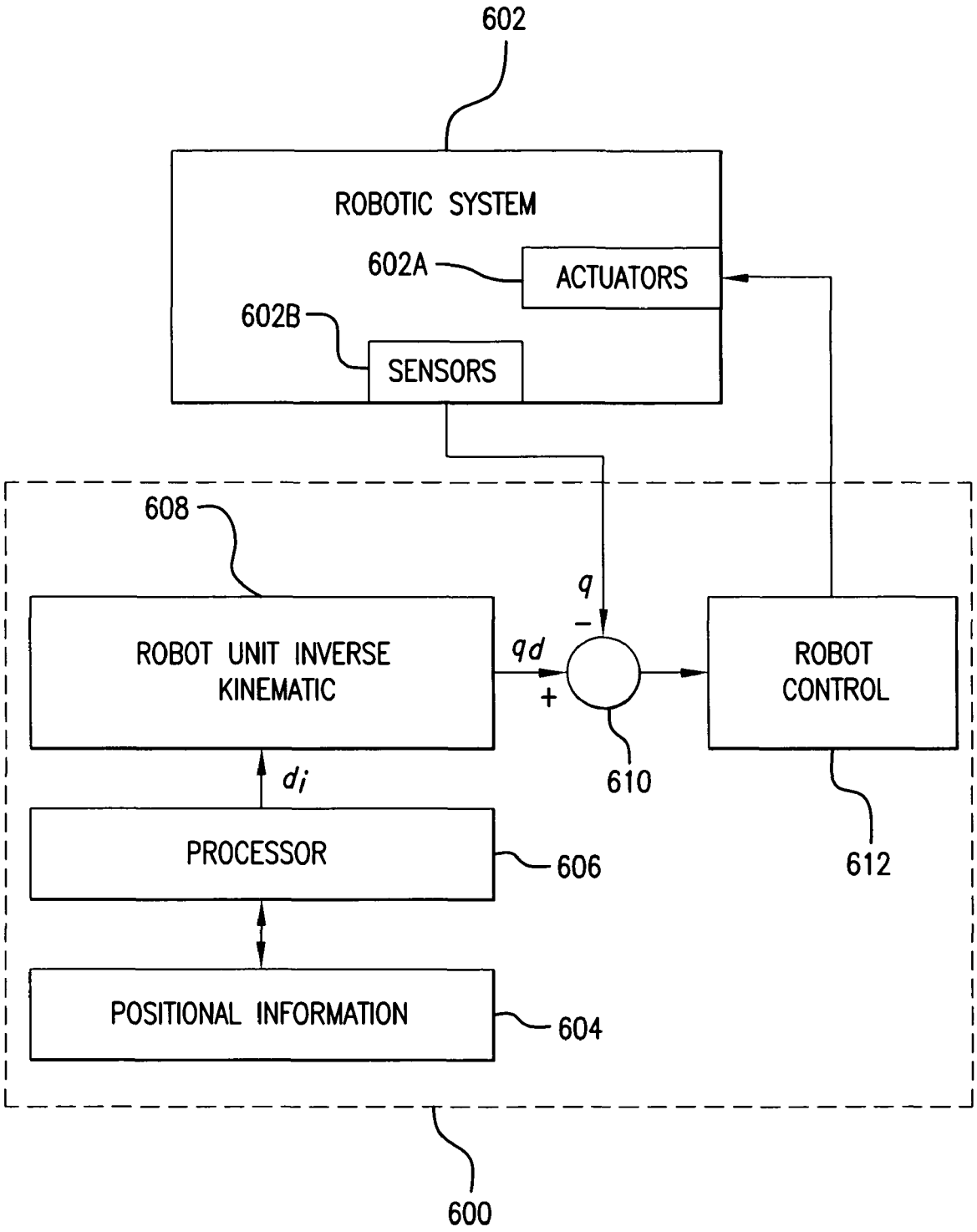
FIG. 17 schematically depicts a robot control system according to another embodiment of the invention

FIG. 17 schematically depicts a system controller 600 for a robotic system 602 such as, for example, system 10 of FIGS. 1-5C described above. Robotic system 602 comprises a plurality of actuators 602A for effecting movement of the components of system 602, and a plurality of sensors 602B for providing positional information about the components of system 602. Controller 600 is similar to controller 210 described above with reference to FIGS. 8 and 9, except that instead of any machine vision system, controller 600 comprises a memory storing positional information 604 coupled to a processor 606. Processor 606 may determine the target position $d_i$ of end effector based on positional information 604 and input from an operator who may indicate that a pipe 130 is ready to be grabbed from an elevator axis (for a tripping out operation) or pipe rack (for a tripping in operation), as described below. Controller 600 comprises a robot unit inverse kinematic component 608, which processes target position $d_i$ to obtain a set of desired coordinates $q_d$ for robotic system 602 (in the measurement space of the position sensors of robotic system 602). Comparison component 610 then compares the desired coordinates $q_d$ for robotic system 602 to the actual robot unit coordinates q (i.e. robot unit position data sensed by the sensors of robotic system 602). Robot control component 612 then uses the differences between the actual coordinates q and the desired coordinates $q_d$ to generate appropriate control signals 614 for the actuators of robotic system 602.

Figure 18:
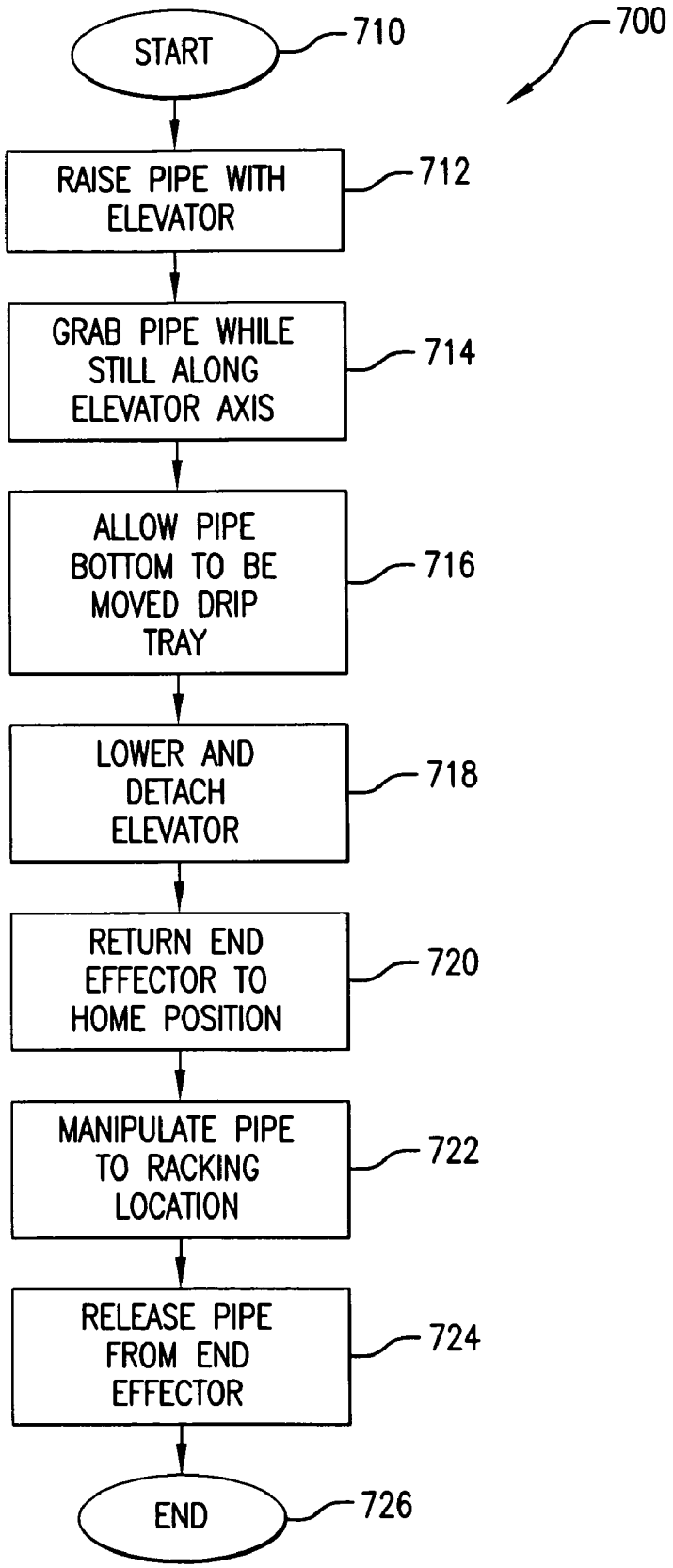
FIG. 18 depicts a method for tripping out a pipe according to another embodiment of the invention.
Figure 19A:
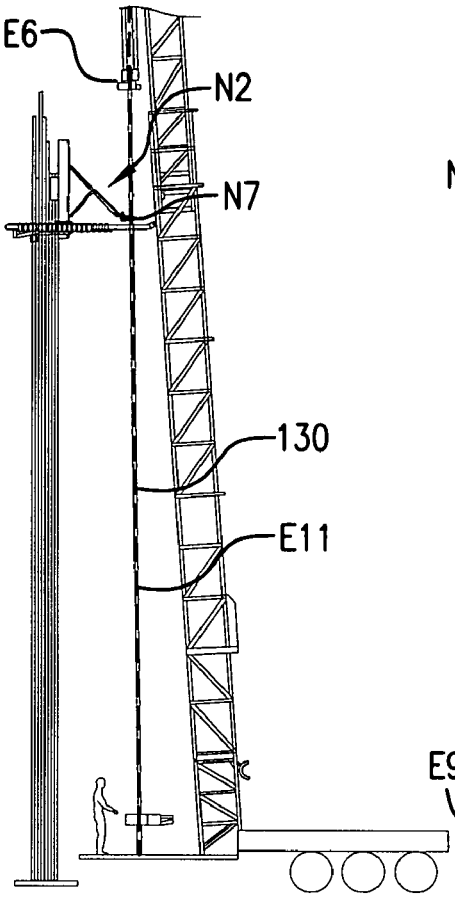
FIGS. 19A-D schematically depict steps involved in the tripping out operation according to the embodiment of FIG. 18; and, FIGS. 20A and 20B schematically depict a portion of an elevator according to one embodiment of the invention.

FIG. 18 schematically depicts a method 700 for tripping out a pipe 130 according to a particular embodiment of the invention. Method 700 may be carried out, for example, by a system such as system 10 of FIGS. 1-5C described above, under control of a suitably programmed system controller, such as, for example, controller 600 of FIG. 17. Method 700 commences in block 710 and proceeds to block 712, where a pipe 130 is raised by elevator E6 and unscrewed from the pipe(s) remaining in the well, as described above. Method 700 then proceeds to block 714, where controller 600 causes end effector N7 to grab pipe 130 while pipe 130 is still oriented along elevator axis E11, as shown in FIG. 19A. Positional information 604 may comprise information specifying the position of elevator axis E11 to facilitate the grabbing of pipe 130 by end effector N7.

Figure 19B:
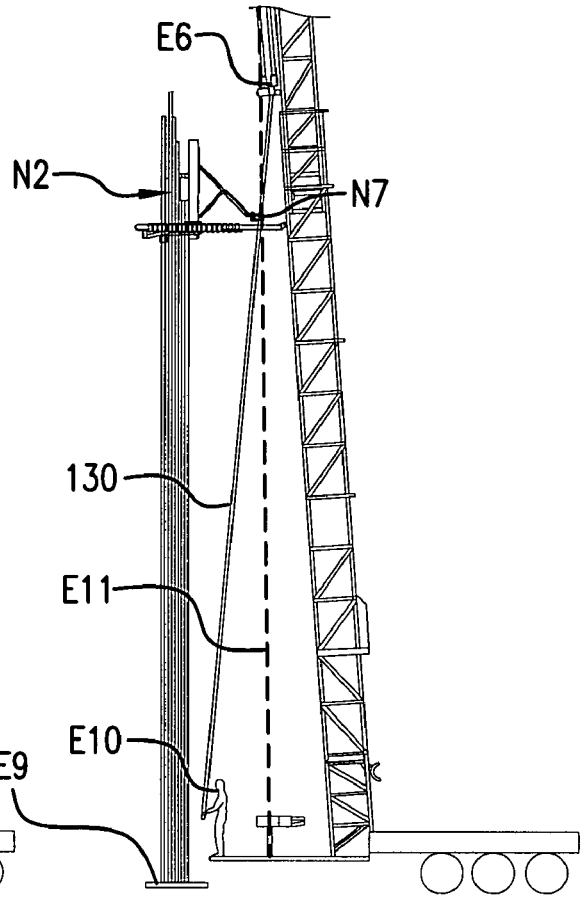

Next, method 700 proceeds to block 716, where, a human drill head operator E10 (FIG. 1) guides the lower end of pipe 130 over drip tray E9, as shown in FIG. 19B. Controller 600 may facilitate such movement of the lower end of pipe 130, for example, by allowing end effector N7 to be moved by the movement of the lower end of pipe 130 (referred to herein as "zero torque mode"), or by responding to torque detected by sensors of robotic system N2 to assist the movement of pipe 130 (referred to herein as "torque feedback mode") by moving end effector N7 to reduce the torque exerted on robotic system N2 due to the movement of the bottom portion of pipe 130. When the lower end of pipe 130 is positioned over the drip tray E9, the orientation of pipe 130 is no longer vertical, and elevator E6 may be displaced some distance away from elevator axis E11 in an opposite direction from drip tray E9.

Next, method 700 proceeds to block 718, where elevator E6 is lowered by operator E10 such that pipe 130 rests on drip tray E9, and elevator E6 is detached from pipe 130. Detaching of elevator E6 could be effected by operator E10 or triggered by one or more sensors in drip tray E9. Just prior to detaching elevator E6, controller 600 may cause end effector N7 to pull back a short distance from elevator axis E11 toward drip tray E9, such that elevator E6 is more closely aligned with elevator axis E11 and swinging of elevator E6 is reduced or eliminated.

Figure 19C:
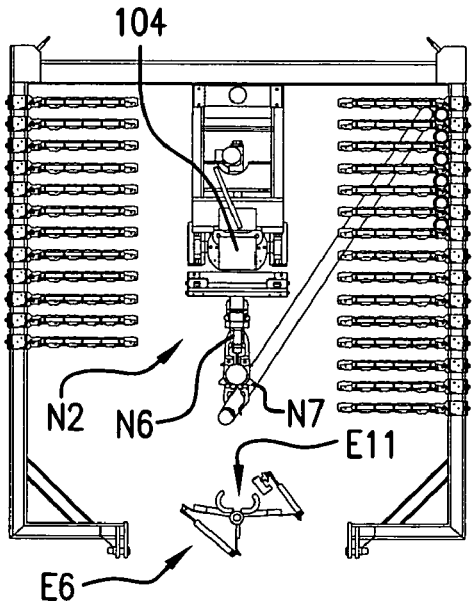

Next, method 700 proceeds to block 720, where controller 600 causes end effector N7 to return to a "home" position with pipe 130, as shown in FIG. 19C. The home position may be achieved, for example, by retracting arm N6 such that end effector N7 is as close as possible to mast 104 with arm N6 and end effector N7 aligned along a line between mast axis 117 and elevator axis E11. Positional information 604 of controller 600 may store information specifying the home position.

Figure 19D:
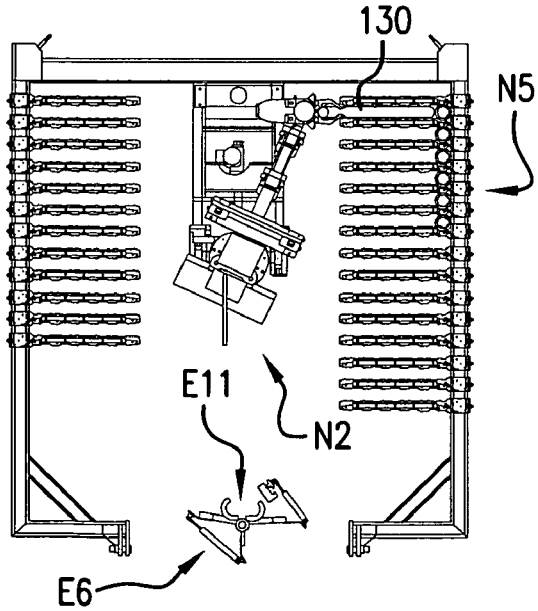

Next, method 700 proceeds to block 722, where controller 600 causes end effector N7 to manipulate pipe 130 to the open end of rack N5, as shown in FIG. 19D, and then push pipe 130 into its racking location. Controller 600 may, for example, cause end effector N7 to move pipe along a predetermined path from the home position to the racking location of pipe 130, as specified by information stored in positional information 604. The racking location for pipe 130 preferably corresponds to a location of the bottom of pipe 130 in drip tray E9. Next, method 700 proceeds to block 724, where controller causes end effector N7 to release pipe 130 when pipe is in its racking location, and then return to the home position to prepare for the next tripping operation. Method 600 then ends at block 726.

Figure 20A:
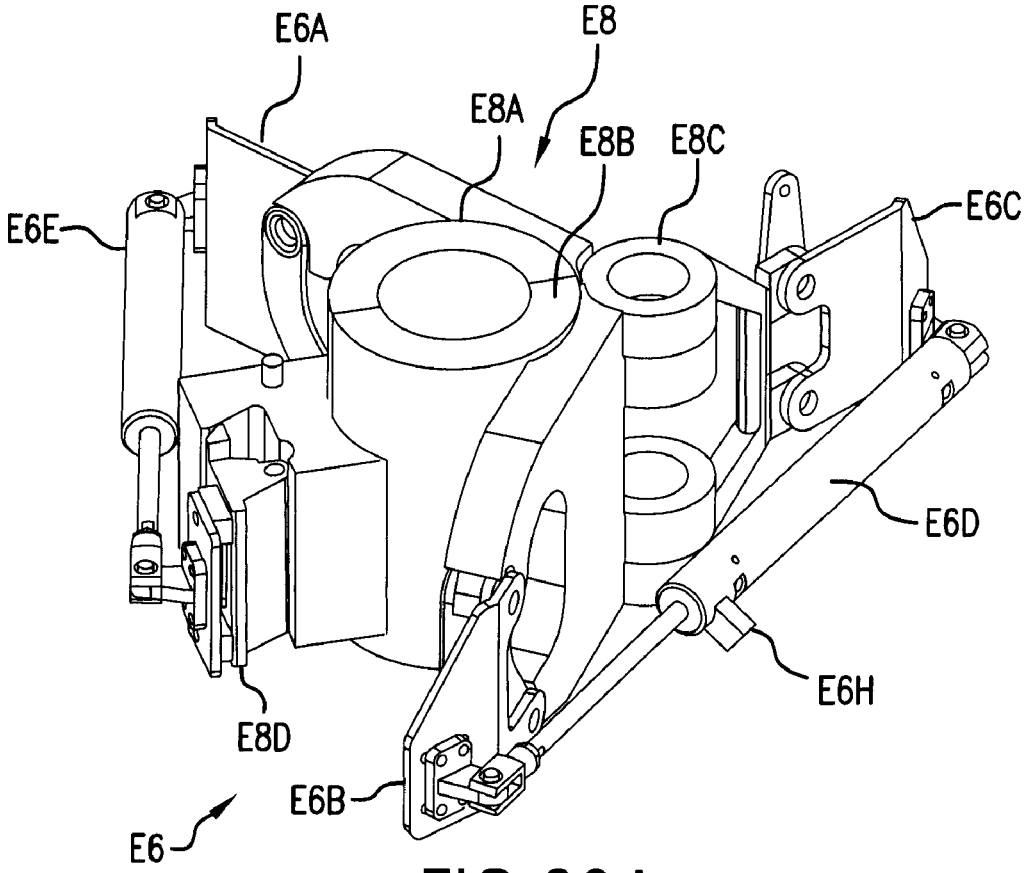
Figure 20B:
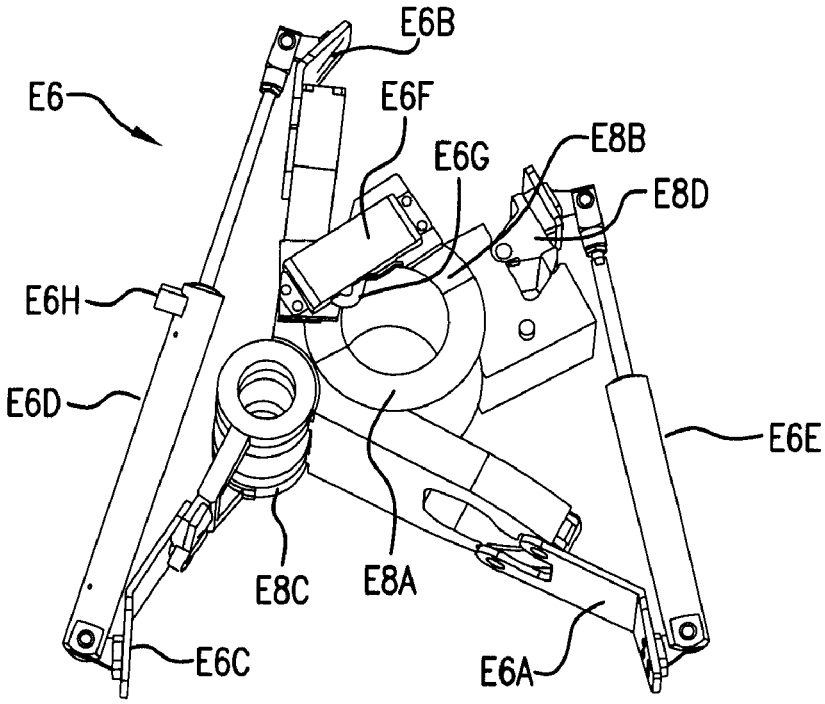

FIGS. 20A and 20B schematically depict an elevator E6 according to one embodiment of the invention. Elevator E6 comprises a pipe coupler E8 comprising two collar portions E8A and E8B pivotally coupled together by a pipe coupler pivot joint E8C. A locking mechanism E8D is operable to selectively lock collar portions E8A and E8B in a closed position shown in FIGS. 20A and 20B. The details of construction of collar portions E8A and E8B, pipe coupler pivot joint E8C and locking mechanism E8D are known in the art, and are not specifically illustrated or described in detail.

In the embodiment of FIGS. 20A and 20B, extension flanges E6A, E6B and E6C are respectively coupled to collar portions E8A and E8B and pipe coupler pivot joint E8C. A pipe coupler actuator E6D is connected between extension flanges E6B and E6C, such that movement of pipe coupler actuator E6D into an extended position forces collar portions E8A and E8B together into the closed position shown in FIGS. 20A and 20B, and movement of pipe coupler actuator E6D into a retracted position forces collar portions E8A and E8B apart (if locking mechanism E8D is not locked) into an open position (not shown). Pipe coupler actuator E6D may comprise, for example, a pneumatic cylinder, and may include one or more sensors E6H for providing a system controller of a robotic system such as those discussed above with an indication of when pipe coupler actuator E6D is in the extended position or the retracted position. The operation of pipe coupler actuator E6D may be controlled by the system controller. Valves may also be provided to allow manual operation of pipe coupler actuator E6D.

A locking mechanism actuator E6E is connected between extension flange E6A and locking mechanism E8D, such that movement of locking mechanism actuator E6E into an extended position forces locking mechanism E8D into a locked position as shown in FIGS. 20A and 20B, and movement of locking mechanism actuator E6E into a retracted position forces locking mechanism E8D into an unlocked position (not shown). When locking mechanism E8D is in the unlocked position, collar portions E8A and E8B may be moved apart into an open position (not shown). Locking mechanism actuator E6E may comprise, for example, a pneumatic cylinder, and may include one or more sensors (not specifically enumerated) for providing the system controller with an indication of when locking mechanism actuator E6E is in the extended position or the retracted position. The operation of locking mechanism actuator E6E may be controlled by the system controller. Valves may also be provided to allow manual operation of locking mechanism actuator E6E.

Elevator E6 may also comprise a tilting actuator (not shown) to facilitate tilting of elevator E6 to allow pipe coupler E8 to be attached to a horizontally oriented pipe. The tilting actuator may comprise, for example, a pneumatic cylinder. The tilting actuator may be controlled by the system controller, or manually.

A pipe presence sensor E6F (FIG. 20B) may be attached to one of collar portions E8A and E8B for providing the system controller with an indication of when a pipe is located between collar portions E8A and E8B. In the illustrated embodiment, pipe presence sensor E6F comprises a mechanical switch E6G which is activated when a pipe is located between collar portions E8A and E8B. Alternatively or additionally, pipe presence sensor E6F could comprise one or more of a laser sensor, an ultrasonic sensor or a magnetic sensor.

In operation, elevator E6 may be controlled by the system controller in conjunction with the operation of a robotic system for manipulating pipes such as, for example, robotic system N2 (or 602) described above. The system controller may provide control signals and receive feedback signals from the actuators and sensors of elevator E6 though a wireless connection such as, for example, a radio frequency (RF) connection. In tripping out operations, elevator E6 may be controlled to maintain collar portions E8A and E8B in the closed position with locking mechanism E8D in the locked position until the system controller receives confirmation from the sensors of robotic system N2 that a pipe held by elevator has been successfully grabbed by end effector N7. Conversely, in tripping in operations, robotic system N2 may be controlled to maintain grabbing members N7A and N7B of end effector in the closed position until the system controller receives confirmation from the sensors of elevator E6 that a pipe held by end effector N7 has been successfully received in pipe coupler E8 and collar portions E8A and E8B are in the closed position with locking mechanism E8D in the locked position.

While a number of exemplary aspects and embodiments have been discussed above, those of skill in the art will recognize certain modifications, permutations, additions and sub-combinations thereof. For example:

- There are other applications where it is desirable to reduce or eliminate human involvement in re-orienting, guiding, positioning and racking of elongated objects. Solutions which reduce or eliminate human involvement in tripping out and tripping in operations for oil well servicing may also be suitable use in these other applications.
- Racking platform N1 may optionally comprise a safety railing N3 which may be portable and removable from racking platform N1.
- In some of the embodiments described above, image processing component 212 makes use of image data 204 to determine the location of the end 131 of pipe 130 during tripping operations. In other embodiments, other sensors, such as ultrasound sensors, radar sensors, sonar sensors and laser proximity sensors, may be used in addition to or in the alternative to image sensors.
- In one particular embodiment described above, image processing component 212 performs a template matching technique to detect the top 131 of pipe 130. In other embodiments, template matching techniques may be employed which use other vector distance formula (i.e. other than cross-correlation) to provide an estimate of the data that best matches a given template.
- The description set out above provides a number of example methods which may be used to process image data 204 to detect the top 131 of pipe 130. Those skilled in the art will appreciate that there are other techniques which could be used to process image data 204 to detect the top 131 of the pipe 130. For example, a Hough transformation method could be used to detect the top 131 of pipe 130. The invention should be understood to include such techniques in addition to (or as alternatives to) the techniques described herein.

The description set out above provides a number of example methods which may be used to process image data 204 to detect a second point on pipe 130 and/or the orientation of pipe 130. Those skilled in the art will appreciate that there are other techniques which could be used to process image data 204 to detect the second point on pipe 130 and/or the orientation of pipe 130. For example, a template matching method could be used to detect the second point on pipe 130 and/or the orientation of pipe 130. The invention should be understood to include such techniques in addition to (or as alternatives to) the techniques described herein.

The description set out above provide an example technique which may be used to process image data 204 to detect rapid changes in acceleration of pipe 130. Those skilled in the art will appreciate that there are other techniques which could be used to process image data 204 to detect rapid acceleration changes in pipe 130. The invention should be understood to include such techniques in addition to (or as alternatives to) the techniques described herein.

The description set out above refers to tripping pipes in and out of an oil well, but the invention may also have application to tripping portions of a drill string or other elongated objects in and out of wells.

It is therefore intended that the following appended claims and claims hereafter introduced are interpreted to include all such modifications, permutations, additions and sub-combinations as are within their true spirit and scope.

What is claimed is:

1. A robotic system coupled to a racking platform of an oil well service or drilling rig, the robotic system comprising:

a base coupled to the racking platform at a fixed location;

a mast pivotally coupled to the base by a mast pivot joint allowing rotation of the mast about a mast axis;

a mast actuator for controllably rotating the mast about the mast pivot joint;

an arm coupled to the mast, the arm including proximal and distal ends, wherein the distal end is moveable along a radial direction with respect to the mast axis, and wherein the proximal end is moveable along an axial direction with respect to the mast axis;

an arm actuator for controllably moving the arm along the radial direction;

an end effector pivotally coupled to the distal end of the arm by an end effector pivot joint allowing rotation of the end effector about an end effector axis oriented at least substantially parallel to the mast axis, the end effector comprising at least one grabbing member operable to selectively grab an elongated object under control of a grabbing member actuator; and an end effector actuator for controllably rotating the end effector about the end effector pivot joint.

2. The robotic system of claim 1, wherein the base is coupled to the racking platform by a base pivot joint for allowing rotation of the base about an axis at least substantially perpendicular to the mast axis, the robotic system comprising a base actuator for controllably moving the base between an operational position wherein the mast axis is oriented at least substantially perpendicularly to a plane of the racking platform, and a storage position wherein the mast axis lies at least substantially within the plane of the racking platform.

3. The robotic system of claim 1, wherein the arm comprises a plurality of segments pivotally coupled to one another, and wherein a first end of a first segment is connected to the arm actuator, and a first end of a second segment is connected to the mast, such that movement of the first end of the first segment toward the first end of the second segment causes the arm to extend outwardly from the mast along the radial direction.

4. The robotic system of claim 1, wherein the end effector comprises two opposed grabbing members each coupled to a housing of the end effector by at least one fixed pivot joint, the grabbing members moveable between a closed position and an open position under control of the grabbing member actuator.

5. The robotic system of claim 4, wherein the fixed pivot joints comprise a plurality of shock absorbing bushings.

6. The robotic system of claim 4, wherein the grabbing member actuator comprises an extendable member, and the opposed grabbing members are coupled to the extendable member by a pair of pivoting links that are positioned opposed to any opening of the grabbing members when the grabbing members are in the closed position.

7. The robotic system of claim 4, wherein each grabbing member comprises a detachable grabbing portion configured to grab a pipe having a predetermined diameter, such that the end effector may be adapted to grab a plurality of pipes having different diameters by providing different detachable grabbing portions.

8. The robotic system of claim 1, comprising a controller for controlling the operation of the mast actuator, the arm actuator, the end effector actuator and the grabbing member actuator, the controller comprising a processor coupled to a memory storing positional information for manipulating pipes into and out of the racking platform.

9. The robotic system of claim 8, comprising a plurality of sensors for providing the controller with information about the orientations of the mast, arm, end effector and at least one gripping member.

10. The robotic system of claim 1, wherein the mast actuator, the arm actuator and the end effector actuator comprise servo motors.

11. The robotic system of claim 10, wherein the grabbing member actuator comprises a stepper motor.

12. The robotic system of claim 1, further comprising a positional information storing system.

13. A mobile apparatus for oil well servicing or drilling, the apparatus comprising:

a mobile platform;

a derrick pivotally coupled to the mobile platform and moveable between a deployed position and a storage position;

a racking platform coupled to the derrick, the racking platform defining a plurality of elongated object receiving locations;

an elevator supported from the derrick for raising and lowering elongated members along an elevator axis; and, a robotic system coupled to the racking platform at a fixed location, the robotic system comprising a mechanism having at least three degrees of freedom for manipulating an upper portion of an elongated member within a plane at least substantially parallel to a plane of the racking platform, wherein the robotic system comprises:

a mast coupled to the racking platform at the fixed location by a mast pivot joint allowing rotation of the mast about a mast axis oriented at least substantially perpendicularly to the racking platform;

an arm coupled to the mast, the arm including proximal and distal ends, wherein the distal end is moveable along a radial direction with respect to the mast axis, and wherein the proximal end is moveable along an axial direction with respect to the mast axis;

an arm actuator for controllably moving the arm along the radial direction;

an end effector pivotally coupled to the distal end of the arm by an end effector pivot joint allowing rotation of the end effector about an end effector axis oriented at least substantially parallel to the mast axis, the end effector comprising at least one grabbing member operable to selectively grab an elongated object under control of a grabbing member actuator; and an end effector actuator for controllably rotating the end effector about the end effector pivot joint.

14. The apparatus of claim 13, wherein the racking platform is pivotally coupled to the derrick, and wherein the robotic system is pivotally coupled to the racking platform at the fixed location, such that the racking platform and the robotic system are moveable into at least substantially parallel orientations with respect to the derrick when the derrick is in the storage position.

15. The apparatus of claim 13, wherein the racking platform comprises:

a frame;

a plurality of finger members mounted on the frame, wherein a pair of adjacent finger members defines an elongated object receiving path therebetween, and wherein a first one of the pair of adjacent finger members comprises a plurality of arcuate indentations defining the elongated object receiving locations along an edge thereof; and a plurality of toggle locks mounted on pivot joints on a second one of the pair of adjacent finger members, the toggle locks coupled in complementary pairs biased into a predetermined angular relationship with one another such that when one of the toggle locks of a complementary pair is pivoted out of the elongated object receiving path the other of the toggle locks in the complementary pair is urged into the elongated object receiving path, wherein a last complementary pair of toggle locks comprises a biasing mechanism configured to bias a last toggle lock closest to the frame into the elongated object receiving path.

16. The apparatus of claim 13, wherein the elevator comprises:

an elongated object coupler for selectively engaging an upper portion of an elongated object, the elongated object coupler moveable between an open position and a closed position;

an elongated object coupler actuator for moving the elongated object coupler between the open position and the closed position; and an elongated object coupler sensor for producing an indication of whether the elongated object coupler is in the open position or the closed position.

17. The apparatus of claim 16, wherein the elevator comprises:

a locking mechanism for selectively locking the elongated object coupler in the closed position, the locking mechanism moveable between a locked position and an unlocked position;

a locking mechanism actuator for moving the locking mechanism between the locked position and the unlocked position; and a locking mechanism sensor for producing an indication of whether the locking mechanism is in the open position or the closed position.

18. The apparatus of claim 17, wherein the elevator comprises an elongated object presence sensor for producing an indication of whether the upper portion of an elongated object is engaged by the elongated object coupler.

19. A method of removing an elongated object from an oil well, the method comprising:

providing an apparatus according to claim 13;

raising the elongated object along the elevator axis with the elevator;

grabbing an upper portion of the elongated object with the robotic system while the elongated object is located along the elevator axis;

allowing a bottom portion of the elongated object to be moved over a tray located below the racking platform;

lowering the elevator such that a bottom end of the elongated object rests on the tray at a location corresponding to a selected one of the elongated object receiving locations defined by the racking platform; and moving the upper portion of the elongated object to the selected one of the elongated object receiving locations defined by the racking platform.

20. The method of claim 19, wherein allowing the bottom portion of the elongated object to be moved comprises allowing the robotic system to be moved by torque exerted thereon due to movement of the bottom portion of the elongated object, or detecting torque exerted on the robotic system due to movement of the bottom portion of the elongated object and assisting the movement of the bottom portion of the elongated object by moving the robotic system to reduce the torque exerted thereon, or both.

21. The method of claim 19, wherein moving the upper portion of the elongated object to the selected one of the elongated object receiving locations comprises returning the robotic system to a home position and then moving the robotic system along a predetermined path from the home position to the selected one of the elongated object receiving locations.

* * * * *